United States Patent [19]

Hamada et al.

[11] Patent Number: 4,837,877

[45] Date of Patent: Jun. 13, 1989

[54] ELEVATION BED

[75] Inventors: Takeaki Hamada; Akio Okada; Kiyoshi Abe; Katsuhiro Udagawa; Fumitoshi Okazaki; Kouji Fujino, all of Tokyo, Japan

[73] Assignee: Sanwa Shutter Corporation, Tokyo, Japan

[21] Appl. No.: 114,404

[22] Filed: Oct. 28, 1987

[30] Foreign Application Priority Data

| | | | |
|---|---|---|---|
| Jan. 20, 1987 | [JP] | Japan | 62-6639 |
| Jan. 20, 1987 | [JP] | Japan | 62-6640 |
| Jan. 30, 1987 | [JP] | Japan | 62-11353 |
| Jan. 30, 1987 | [JP] | Japan | 62-11354 |

[51] Int. Cl.[4] ..... A47C 19/06

[52] U.S. Cl. ..... 5/10 B; 5/10 R; 5/11; 5/63

[58] Field of Search ..... 5/63, 10 R, 10 B, 11, 5/64, 65, 83, 88, 85; 312/246; 108/149

[56] References Cited

U.S. PATENT DOCUMENTS

| | | | |
|---|---|---|---|
| 593,445 | 11/1897 | Toal | 5/10 B |
| 1,065,740 | 6/1913 | Sorlien | 5/10 B |
| 1,696,412 | 12/1928 | Price | 5/10 B |
| 2,052,790 | 9/1936 | Norton | 5/10 B |
| 2,590,337 | 3/1952 | McNabb et al. | 5/63 |
| 2,913,737 | 11/1959 | McNabb | 5/63 |
| 3,028,606 | 4/1962 | Boutet | 5/9 R |
| 3,032,154 | 5/1962 | McNabb | 192/16 |
| 3,494,656 | 3/1952 | McIntire | 296/156 |
| 3,648,304 | 3/1972 | Ogui | 5/10 R |
| 3,665,527 | 5/1972 | Gonzalez | 5/10 B |
| 3,772,716 | 11/1973 | Ratcliff | 5/10 R |
| 3,882,554 | 5/1975 | Glass | 5/10 R |
| 4,058,860 | 11/1977 | Daidone | 5/10 R |

FOREIGN PATENT DOCUMENTS

| | | |
|---|---|---|
| 911046 | 11/1962 | United Kingdom . |
| 2140386 | 11/1984 | United Kingdom . |

*Primary Examiner*—Ramon O. Ramirez
*Attorney, Agent, or Firm*—Ladas & Parry

[57] ABSTRACT

This invention discloses an elevation bed apparatus which moves up and down while keeping its horizontal posture, in order to improve an effective use of an indoor space. The elevation bed of this invention includes an elevation device and a safety device, and the elevation device includes a winding mechanism and a wire driving system of a wire wound on the winding mechanism. A bed main body moves up and down along a guide rail when the wire is wound and rewound. When the elevation bed is of an electric type, the safety device checks the operation or cuts off the power source to stop the elevating motion of the bed main body. This safety device includes all, or the combination, of a safety device consisting of an elevation management mechanism of the elevation bed disposed on the handrail of the bed main body and the upper surface of the peripheral frame of the bed main body, a slack sensor disposed in a winding path of the wire driving system in order to sense the slack of the wire and to cut off the power source, a descension limit sensor disposed on the lower surface of the bed main body and an ascension limit sensor disposed on the surface of the ceiling above the place of disposition of the bed, and an emergency stop safety means. The present invention includes systems which can correspond to the electric and manual elevation beds, respectively, and modified modes of various safety devices, and can be combined freely.

44 Claims, 27 Drawing Sheets

FIG. 9
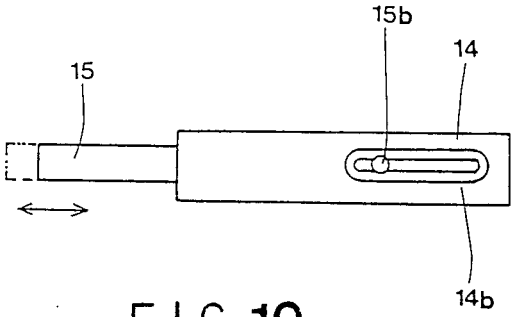
FIG. 10
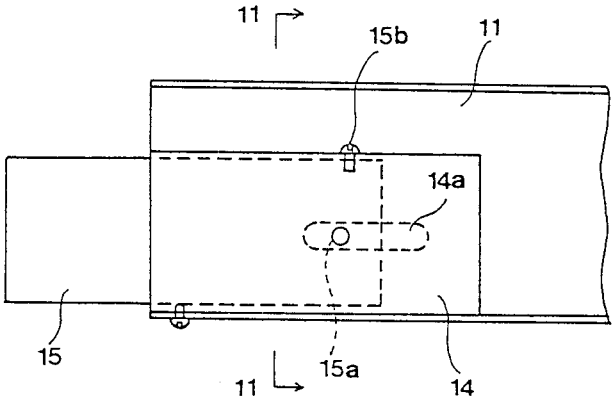
FIG. 11
FIG. 12
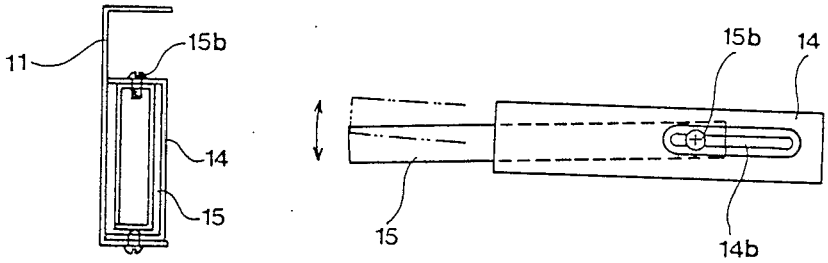

ELEVATION BED

TECHNICAL FIELD

This invention relates to a bed to be installed in a room having a relatively small space. More particularly, the present invention relates to an elevation bed which can be moved between positions where it is used and not used and can be stored so as to utilize effectively the floor space when it is not used, and the invention relates also to a safety device of such a bed.

BACKGROUND ART:

As the ways of living get diversified at present, the number of rooms equipped with a bed or beds is increasing. Particularly in cities, the ratio of housing expenses among the cost of living is ever soaring. On the other hand, the number of single dwellers is increasing and the demand for so-called "one-room apartment house" is increasing, too. If a bed is fixed in such a small room, the floor space occupied by the bed cannot be utilized effectively. Accordingly, the bed cannot be set in practice in a room having a small space. An example of conventional beds to solve this problem has a construction in which one of the ends of the bed is fixed while the other end is pulled up in order to store the bed. According to this bed, however, furniture must be moved when the bed is used and be returned after the bed is stored. In addition, the mat and bedclothes must be bound of stored separately lest they should fall off when the bed is stored.

To eliminates all the problems of the prior art described above, the present invention is directed to provide and elevation bed which includes a bed main body having a frame assembly structure, support rods disposed vertically between the floor and the ceiling, supporting elevatably the bed main body and having a grooved sectional shape, an elevation device for moving up and down the bed main body and a safety device, wherein the elevation device includes a winding mechanism and a wire driving system wound on the winding mechanism and the winding mechanism winds and rewinds the wire so that the bed main body can be moved between the storage position on the ceiling side and the descension position to use the bed while keeping its horizontal posture.

It is another object of the present invention to provide an elevation bed which may be of a type wherein the winding mechanism described above is incorporated in the bed main body or of a type wherein the winding mechanism is mounted to a support structure formed at the upper part of the support rods, and which may bed of an electric type or of a manual type.

When the elevation bed is of the electric type, it is still another object of the present invention to provide a slack sensor which detects the slack of the wire driving system of the winding mechanism and cuts off a power source.

It is still another object of the present invention to provide an elevation management mechanism for managing the elevating operation of the bed main body by constituting the guard handrail, which is disposed around the bed main body of the electric type elevation bed, in such a manner that it can be turned up and down, and at the time of use when the guard handrail is erected, a management switch operates to manage the elevating operation of the bed main body.

It it still another object of the present invention to provide an elevation management mechanism for manually managing the elevating operation of the bed main body by assembling a management switch in a decorative edge around the periphery of the bed main boby so as to constitute a touch sensor.

It is still another object of the present invention to provide an ascension limit sensor for limiting the upper limit of ascension of the bed main body by assembling an operation plate and a sensing switch in the ceiling above the bed main body so as to constitute a touch sensor.

It is a further object of the present invention to provide an ascension limit sensor for limiting the upper limit of ascension of the bed main body by constituting a photoelectric switch near the ceiling surface above the bed main body.

It is still another object of the present invention to provide a descension limit sensor for limiting the lower limit of descension of the bed main body by assembling an operation plate and a sensing switch in the lower surface of the bed main body to constitute a touch sensor.

It is still another object of the present invention to provide a stopper for setting the lower limit of descention of the bed main body by anchoring a stopper vertically movably at the lower part of support rods forming guide rails.

It is still another object, but not the last object, of the present invention to provide an emergency stop device for preventing the drop of the bed main body when the wire is broken accidentally.

DISCLOSURE OF INVENTION:

The present invention is characterized in that a plurality of engagement assemblies projecting from the bed main body are filled elevataly to vertical guide rails that are implanted between the floor of a room and the ceiling, a wire is stretched between a structure including each guide rail and the bed main body so as to keep the horizontal posture of the bed main body by the tension of the wire, the wire is connected to a winding mechanism equipped with driving means so that the wire winding and rewinding operation when the winding mechanism is driven can move up and down the bed main body between the the storage position on the ceiling side and the descension position at which the bed can be used while the bed is kept under the horizontal posture, and the elevation bed is equipped with various safety devices.

According to the construction described above, the bed can be kept horizontally at the ceiling portion when it is not used so that the wide effective area can be secured below the bed main body and inconveniences of handling the bedclothes can be eliminated. Though the driving means of the winding mechanism may be either of an electric type or of a manual type, the electric type is more pratical in consideration of the time and labor required and particularly in consideration of the operation by a woman, and safety devices are indispensable for the automatic operation of the bed. The present invention includes multiple safety devices for the elevating operation of the bed, cuts off the power source to check an unexpected start of the bed whether the bed is about to start elevation or is in operation, and is equipped with safety devices for stopping mechanically the drop of the bed at the time of emergency such as breakage of the wire.

BRIEF DESCRIPTION OF DRAWINGS:

FIGS. 7 to 12 are detailed views of engagement assembly, wherein:

FIG. 7 is an end surface view of a main sheave and a sliding roller;

FIG. 8 is a side view of a cylinder member;

FIG. 9 is a top view of the cylinder member;

FIG. 10 is a side view of the engagement assembly;

FIG. 11 is a sectional view taken along line 11—11 of FIG. 10; and

FIG. 12 is a top view similar to FIG. 9 and useful for explaining rocking of the cylinder member;

FIGS. 19 to 22 are detailed views of other embodiments of the stopper, wherein:

FIG. 19 is its top view;

FIG. 20 is its exploded perspective view;

FIG. 21 and 22 are front views at the time of engagement and disengagement;

FIGS. 23 to 42 are explanatory views of safety devices, wherein:

FIG. 23 is a top view of a slack sensor of a wire;

FIG. 24 is its side view;

FIG. 25 is a top view of another embodiment of a slack sensor;

FIGS. 26 to 33 are explanatory view of an elevation management mechanism, wherein:

FIG. 26 is a perspective view of a guard handrail under the erected state;

FIG. 27 is a perspective view of its turnover posture;

FIG. 28 is an exploded perspective view of the lower part of the guard handrail;

FIG. 29 is a front view of another embodiment of the guard handrail;

FIG. 30 is its plan view;

FIGS. 31 and 32 are its detailed views;

FIG. 33 is a detailed sectional view of an ascension limit sensor disposed on a decorative frame of the bed;

FIG. 34 is a top view showing an ascension limit sensor in combination with legs of the guard handrail;

FIG. 35 is a sectional view of still another embodiment;

FIGS. 36 and 37 are sectional views useful for explaining the operation of a descension limit sensor to be disposed on the lower surface of the bed main body;

FIG. 38 is a sectional view of another embodiment of the descension limit sensor;

FIG. 39 is a vertical sectional view of an ascension limit sensor to be disposed on the ceiling;

FIG. 40 is its exploded perspective view;

FIG. 41 is a plan view of another embodiment using a photosensitive sensor for the ascension limit sensor;

FIG. 42 is its vertical sectional view;

BEST MODE FOR CARRYING OUT THE INVENTION:

The construction of the elevation bed of the present invention will be described in detail with reference to some preferred embodiments thereof shown in the accompanying drawings.

Figure 1:
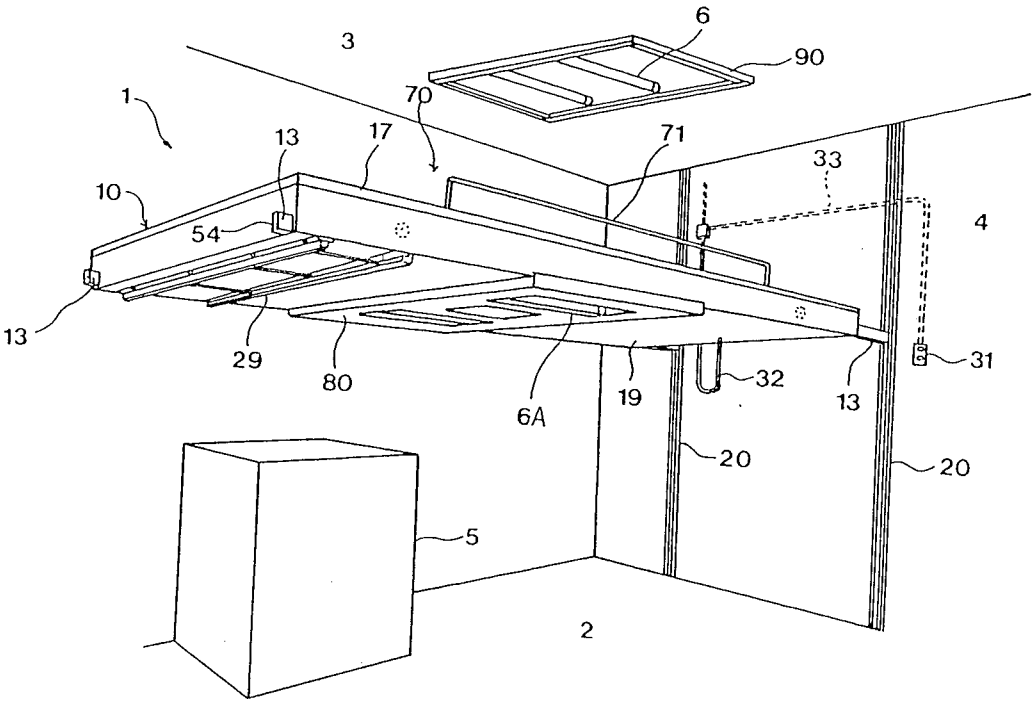
FIG. 1 is a perspective view showing the overall structure of an elevation bed of the present invention inside a room.
Figure 2:
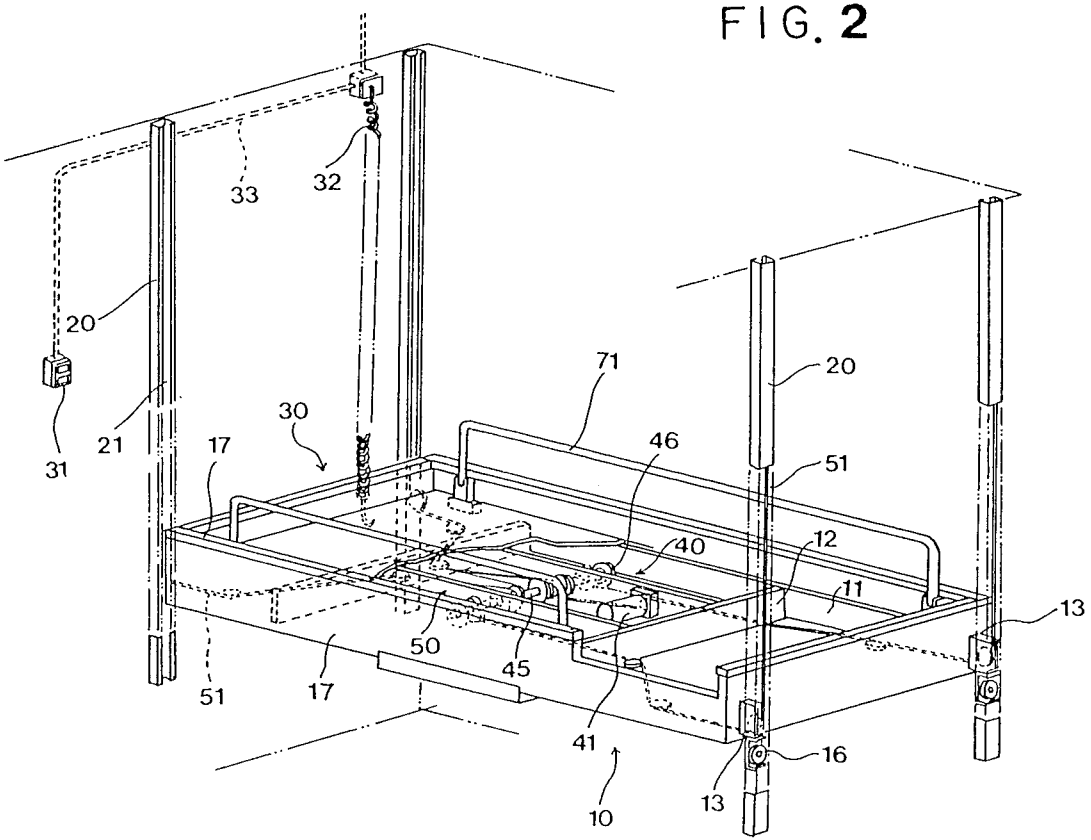
FIG. 2 is partially cut-away perspective view of the upper surface of the elevation bed.

In FIGS. 1 and 2, reference numeral 1 represents the elevation bed as a whole and reference numeral 2 does a floor of a room onto which the elevation bed is set. Reference numerals 3 and 4 represent the ceiling and wall of the room and reference numeral 5 represents an example of furniture to be associated with installation of the elevation bed. Reference numeral 6 represents illumination equipment disposed on the ceiling above the bed 1. Reference numeral 10 represents the main body of the elevation bed and 20 represents generally four support rods that extend from the floor 2 or a portion near the floor 2 to the ceiling 3. Each support rod forms therein a guide rail 21 and is positioned at each corner of the bed main body 10. Reference numeral 30 represents an elevation device for moving up and down the bed main body 10 along the support rods 20, and each portion of the bed will be described elsewhere.

Figure 3:
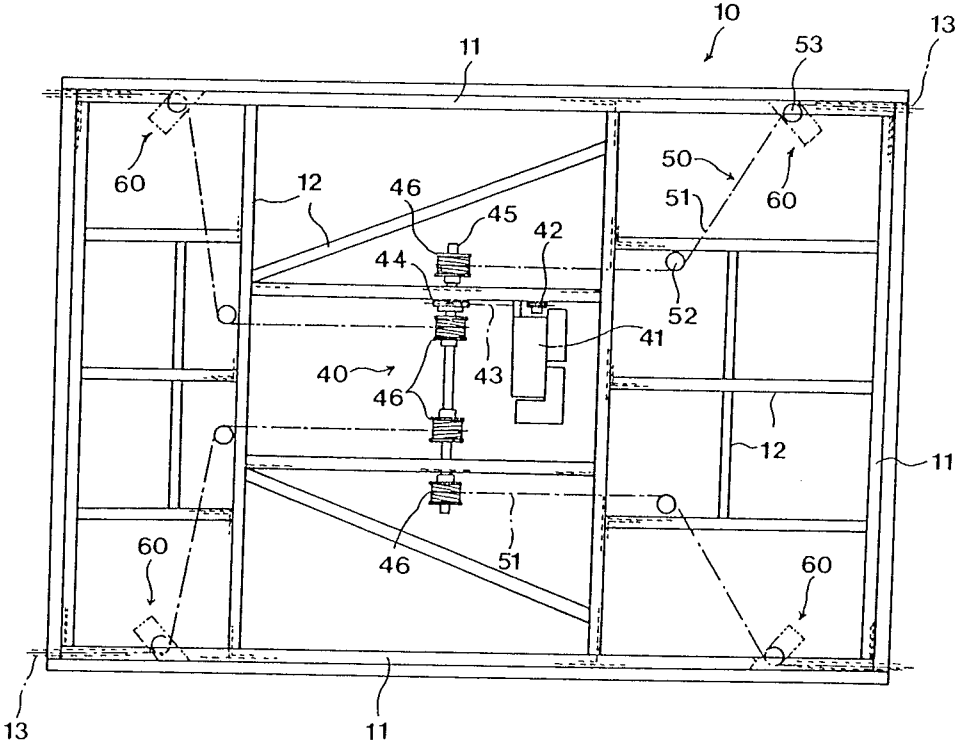
FIG. 3 is a structural plan view of the bed main body.

Next, the elevation bed will be explained with reference also to FIG. 3. The bed main body 10 has a size equal to the size of the beds in general and is assembled in a rectangular form by frame beams 11 at four corners. The bed main body has a frame structure consisting of suitable metal structural members 12 to form the body part of the bed main body 10. A winding mechanism 40 and a driving system 50 are disposed within the range of thickness of this body part while they are supported by the structural members 12. Moreover, various safety means are assembled in the elevation bed 1. The first safety means 60 is a sensor for sensing the slack state of the driving system 50 and is assembled inside the bed main body 10. The second safety means 70 is a management mechanism for managing the basic elevation operation of the elevation bed 1, is divided into two systems of guard handrails to be disposed on the upper surface of the bed and a peripheral frame, and is assembled in the bed main body 10. The third safety means 80 is a sensor for limiting the lower limit of the descension of the bed main body 10, and is disposed on the lower surface of the bed main body 10 as shown in FIG. 1. The fourth safety means 90 is a sensor for limiting the ascension of the bed main body 10 and is assembled in the illumination equipment 6 disposed on the ceiling 3.

Figure 4:
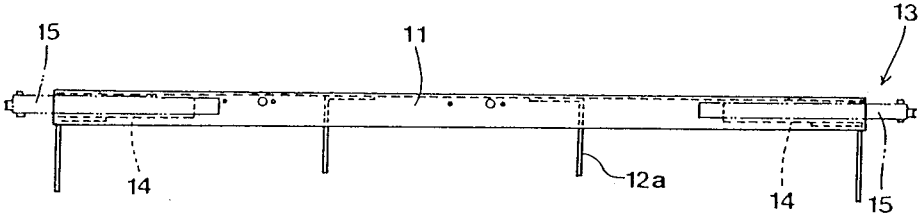
FIGS. 4 to 6 are plan, side and end views of frame beams of the bed main body, respectively.
Figure 5:
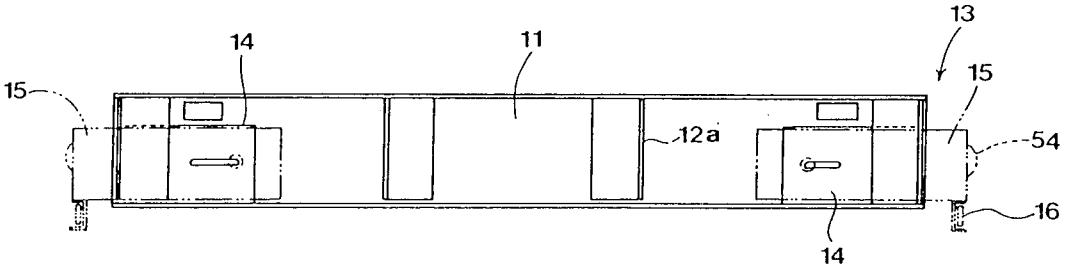
Figure 6:
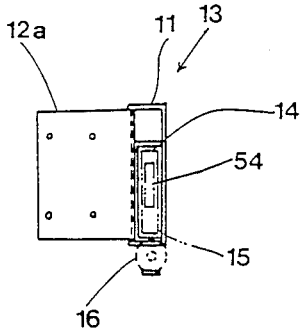
Figure 7:
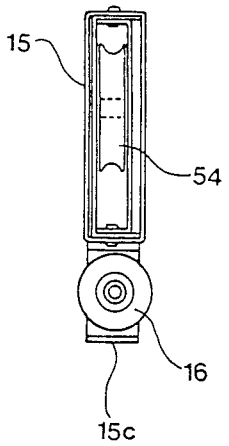
Figure 8:
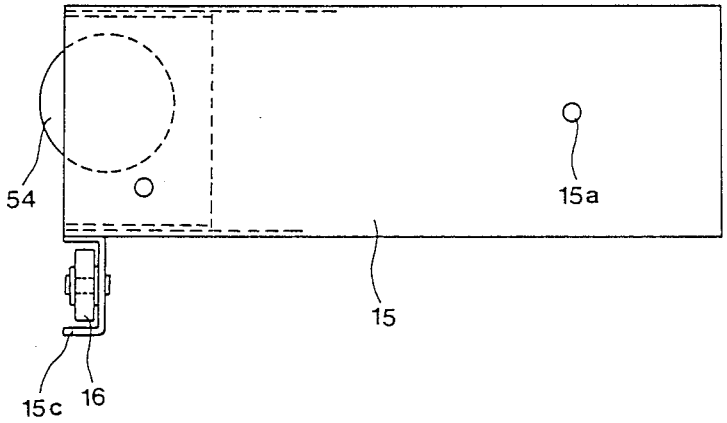
Figure 13:
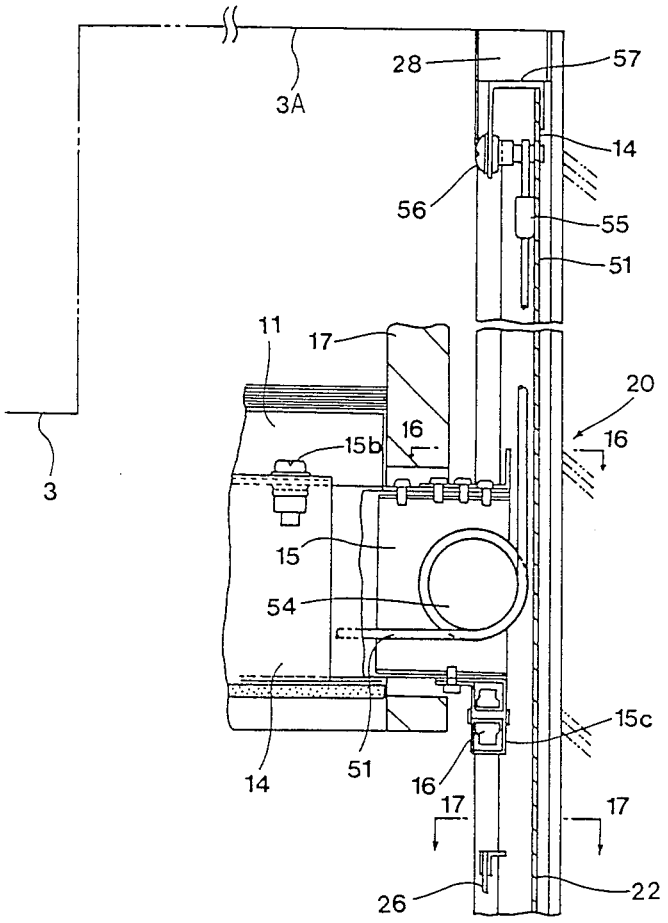
FIG. 13 is a vertical sectional view showing the engagement between support rods and anchor members.

Next, each portion will be described in detail with reference to FIG. 4 and so on. An anchor assembly 13 is disposed at each corner of the frame beam 11 of the bed main body 10 in order to fix the bed main body 10 to each support rod 20. As shown in FIGS. 4 to 6, this anchor assembly 13 consists of a cylinder member 14 fixed at both end portions of the frame beam 11, a support 15 sliding idly inside the cylinder member 14 and a slide roller 16 meshing slidably with the guide rail 21 of the support rod 20. Reference numeral 12*a* in the drawings represents an assembly piece between the frame beam 11 and the structural member 12, but a welding structure can be of course employed. In the support member 15 shown in FIGS. 7 to 12, a pin 15*a* fitted to the side surface of the support member 15 close to its inner end is meshed slidably with an elongated hole 14*a* of the cylinder member 14 and a pin 15*b* fitted to the support member 15 is meshed slidably and swingably with an elongated hole 14*b* of the cylinder member 14. The tip of the support member 15 faces inside the groove of the support rod 20 and a support piece 15*c* fixed to the lower surface of the tip of the support member 15 supports pivotally a slide roller 16 inside a vertical plane. The diameter of this slide roller 16 is greater than the width of the support member 15. Reference numeral 54 in the drawings represents a main sheave constituting part of the later-appearing driving system 50 but this can be called anchor means and included in the anchor assembly 13.

Figure 14:
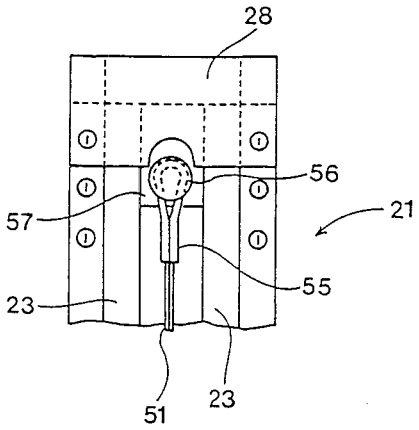
FIGS. 14 and 15 are a front view and a top view of the support rod.
Figure 15:
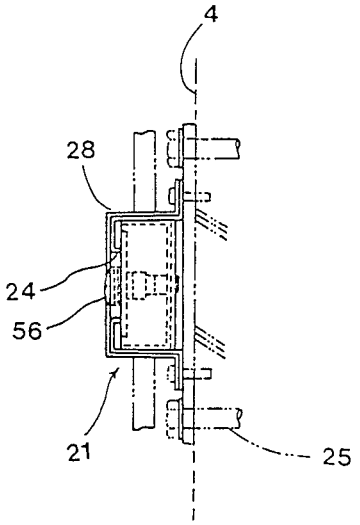
Figure 16:
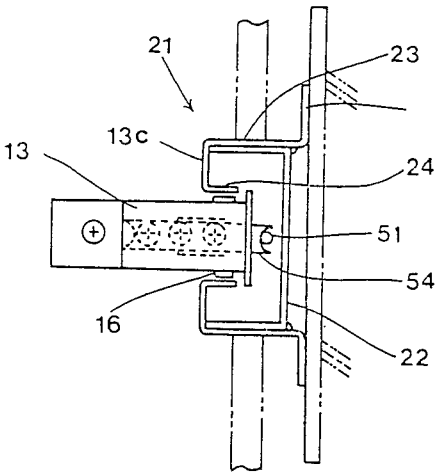
FIG. 16 is a horizontal sectional view of an ordinary part of the support rod along line 16—16 of FIG. 13 and a top view of the anchor assembly.

Next, as shown in FIGS. 13 to 18, the support rod 20 uses a steel material having a grooved cross-section as its principal member 22 and is assembled by bending and molding a belt steel 23 to form the guide rail 21. Moreover, its bent sides 24 faces each other and accept the anchor assembly 13 between them (FIG. 16). FIGS. 14 and 15 are front view and top view of the upper part of the support rod 20. Each support rod 20 is fixed to the wall 4 by fixing members 25 through flange portions of the belt steel 23 at suitable vertical positions. Depending upon the arrangement inside the room, independent rods may be formed naturally. If the ceiling is formed below the beams of an upper floor, it is advisable to employ such an arrangement wherein the ceiling 3 above the upper part of the elevation bed 1 is folded by utilizing the ceiling space to form a ceiling 3A (FIG. 13) and to extend the support rod 20, and the lower surface of the elevation bed 1 is aligned with the same level as the ordinary portion of the ceiling 3.

Figure 17:
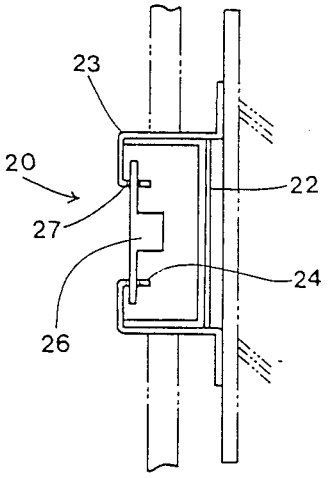
FIG. 17 is a top view of a stopper along line 17—17 of FIG. 13.
Figure 18:
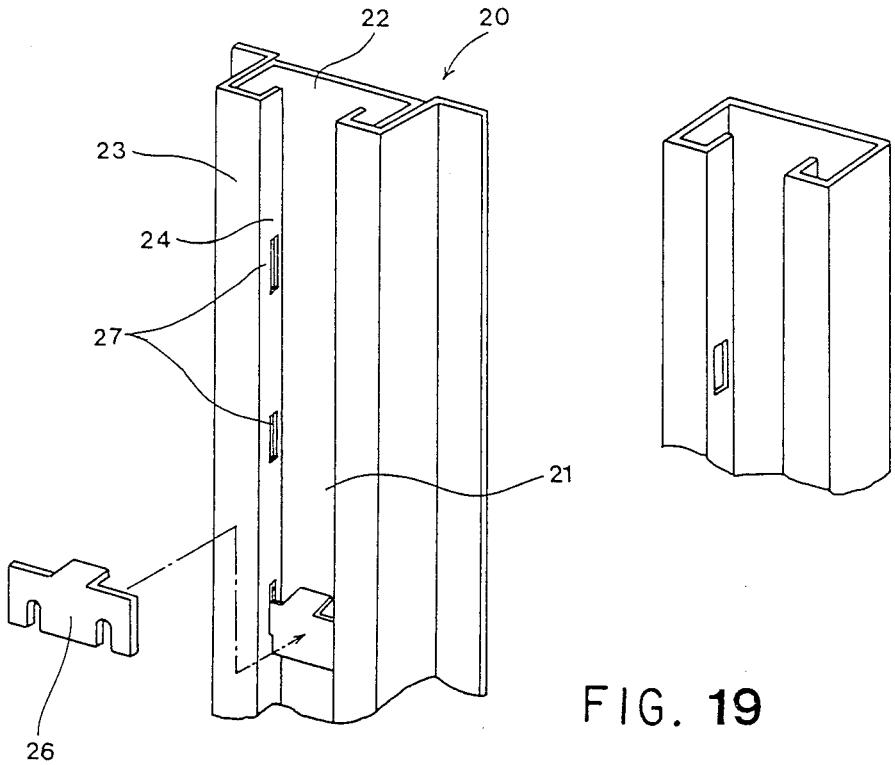
FIG. 18 is an exploded perspective view of the stopper.
Figure 19:
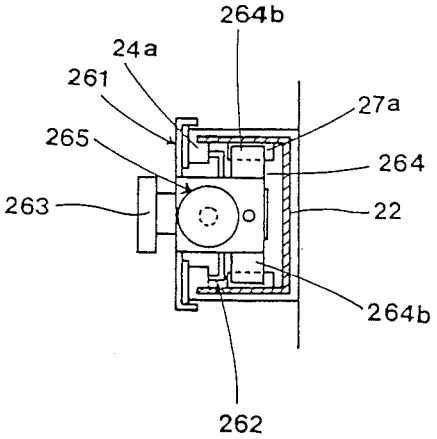
Figure 20:
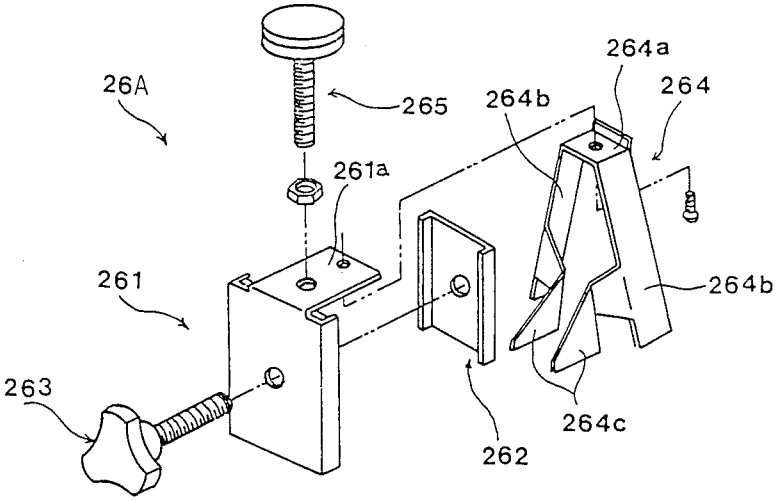

A stopper 26 is disposed at the lower limit position of discension of the bed main body 10 below the support rod 20 in such a manner as to mesh with the bent sides 24 and to bridge over the open groove, as shown in FIGS. 17 and 18. The lower limit position of this stopper 26 can be adjusted vertically by a plurality of engagement groove holes 27 bored on the bent sides 24. On the other hand, a cap 28 is fitted to the upper end of the support rod so as to fill the gap between the ceiling 3 and the support rod 20 which is produced as a component part.

When the stopper 26 limits the upper position higher than the suitable furniture 5 as the lower limit position of the bed main body 10, a ladder 29 having several footholds is used in order to fit the stopper 26 movably up and down on the bed main body 10. The ladder 29 may be fitted foldably to the lower surface of the bed main body 10 as shown in FIG. 1, or a separate ladder 29 may be detachably prepared.

The stopper 26 may have a verrtically movable structure by means of elastic engagement and disengagement between a stopper assembly 26A and the main member 22 as shown in FIGS. 19 to 22. The stopper assembly 26A consists of an outer anchor plate 261, an inner anchor plate 262 disposed inside so as to face the outer anchor plate 261, a fixing screw 263 for fixing both anchor plates 261 and 262, an operation member 264 disposed inside the guide rail 21 and having a substantially inverted V-shape and an adjustment screw 265 meshing with a horizontal portion 261*a* formed by bending the upper part of the outer anchor plate 261.

Figure 21:
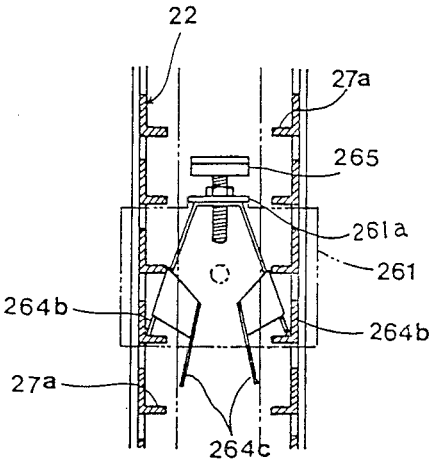
Figure 22:
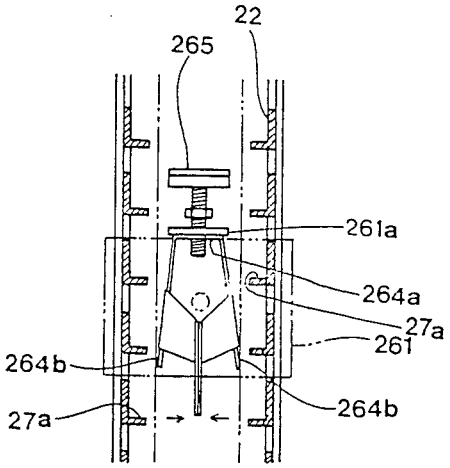

On the other hand, a bent side 24*a* is formed in front of the guide rail 21, and an engagement plate 27*a* is formed by cutting up the flange 22*a* of the main member 22 in its full length. The operation member 264 is molded from an elastic metal sheet and consists of a top portion 264*a*, -shaped leg plates 264*b* and knob plates 264*c* projecting forward from the lower end portions of both leg plates 264*b*. The top portion 264*a* is fixed to the horizontal portion 261*a* of the outer anchor plate 261 by the fixing screw 264*d*. When both outer and inner anchor plates 261 and 262 are fastened and fixed by the fixing screw 263 while interposing the bent side 24*a* at a predetermined height of the guide rail 21, the operation member 264 biased so as to open its legs strikes the upper surface of the engagement plate 27*a* as shown in FIG. 21 and the stopper assembly 26A is fitted to the support rod 20 at this position. When the adjustment screw 265 is moved up and down with respect to the horizontal portion 261*a*, the lower limit position of descension of the bed main body 10 is set. The stopper assembly 26A can be moved to other positions by closing the open legs of both legs 264*b* by gripping the knob plate 264 and disengaging its tip from the anchor plate 27*a*.

Next, elevation means 30 includes a winding mechanism 40, a driving system 50, an elevation push button 31, coil cables 32 for connecting a high position of the wall 4 to the bed main body 10 and supplying electric power, wirings 33 for connecting the coil cables 32 and other power wirings, not shown in the drawings.

The winding mechanism 40 consists of a motor 41, a driving sprocket 42 fitted to the rotary shaft of the motor, a follower sprocket 44 to which revolution of the motor is transmitted by a chain 43, a rotary shaft 45 of the follower sprocket 44 and four wire drums 46 fixed to this rotary shaft. The driving system 50 consists principally of a wire 51. As can be best seen from FIGS. 3 and 13, after one of the ends of this wire 51 is fixed to each wire drum 46, the wire is then wound on an intermediate sheave 52 supported by the structural member 52 and other intermediate sheave 53, passes through the cylinder member 14 and through the inside of the support rod 15 and is wound on the main sheave 54 which is pivotally supported at the tip of the support member 15. The wire 51 changes its direction upward from the position of this sheave is passed through the support rod 20 and reaches the upper part of the support rod 20. The other end 55 of the wire is fixed by the fixing pin 56 disposed at the upper part of the support rod 20. The fixing pin 56 is supported by double shear by the bent member 57. The main sheave 54 is pivotally supported in such a manner as to project from the tip of the support member 15 into the guide rail 20.

Figure 23:
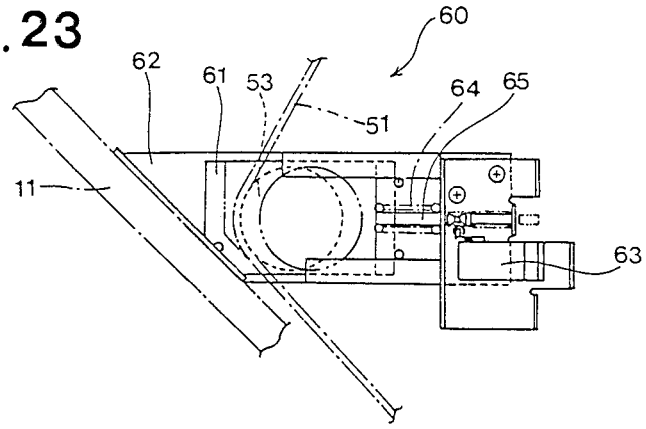
Figure 24:
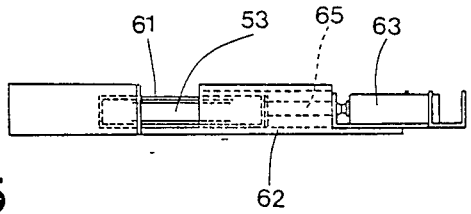

As one item of the furniture, the elevation bed 1 is large in size and hence safety means is of specific importance. Therefore, sufficient safety is secured for the power source for the elevation of the bed main body 10. The first safety device 60 is a sensor for sensing the slack of the wire at the wound portions in order to ensure the normal operation of the wire 51 for elevation driving. In other words, as shown in detail in FIGS. 23 and 24, this slack sensor 60 is disposed at the position of the intermediate sheave 53 and consists of a bed seat 61 for pivotally supporting the intermediate sheave 53, a bracket 62 for supporting movably this bed seat 61 with respect to the frame beam 11 of the structural member, a sensing switch 63 disposed on this bracket 62 in such a manner as to face the bed seat 61, a coil spring 64 for biasing and supporting the bed seat 61, disposed between the bed seat 61 and the switch 63 and an operation rod 65 having one of its ends fixed to the bed seat 61, inserted into the coil spring 64 and anchored to the switch 63.

The slack sensor 60 operates in the following way. When the bed main body 10 descends to a predetermined position, strikes the stopper 26 and stops there, tension of the wire 51 is lost and the coil spring 64 then moves the bed seat 61 and along therewith, the operation rod 65 operates the sensing switch 63 due to the difference of the diameters and lets it cut off the power source. Needless to say, the slack sensor operates in the same way when the wire 51 is cut off.

Figure 25:
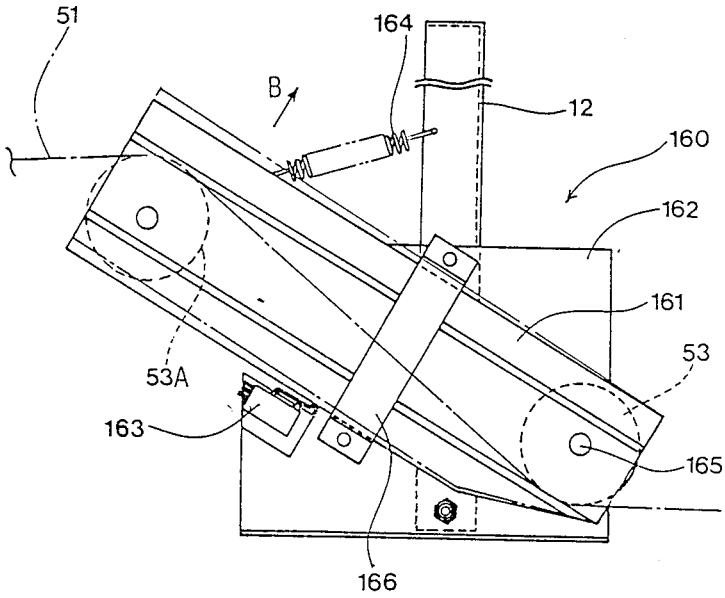

FIG. 25 shows another embodiment of the slack sensor. This slack sensor 160 consists of the bed seat 161 for pivotally supporting the intermediate sheave 53, the bracket 162 for supporting swingably the bed seat 161, fixed to the frame beam 11 of the bed main body 10, the sensing switch 163 for sensing the slack state of the wire 51 wound on the sheave 53 and the spring 164 for connecting the bed seat 161 to the structural member 12 of the bed main body 10. The intermediate sheave 53 and one end portion of the bed seat 161 are in common supported pivotally by a support shaft 165 that is fixed to the bracket 162. The bed seat 161 is a considerably elongated member, and another intermediate sheave 53A is pivotally supported at a position close to the other end of the bed seat 161 and the wire 51 from the sheave 53 is wound on the intermediate sheave 53A. This portion supports also one of the ends of the spring 164 and rocking portion at the intermediate part is limited within the width of the limit member 166 fixed at tis both ends to the bracket 162. The sensing switch 163 is supported and fixed by the bracket 162 sideways of the bed seat 161. When tension of the wound wire 51 is lost, the bed seat 161 is rocked by the spring 164 and cuts off the contact. Accordingly, the power source of the elevation bed 1 is cut off. This slack sensor 160 is relatively small in size and is characterized in that the wire 51 does not come off because the relation of position between the intermediate sheave 53 and the main sheave 54 is constant.

Figure 26:
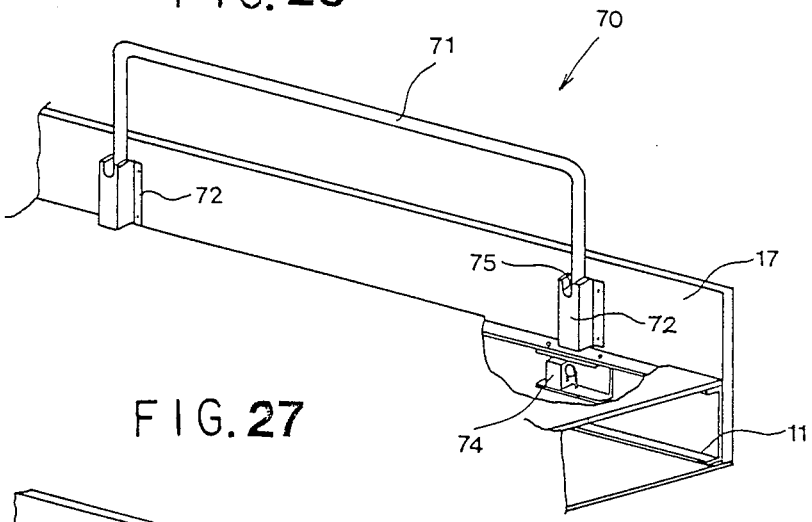
Figure 27:
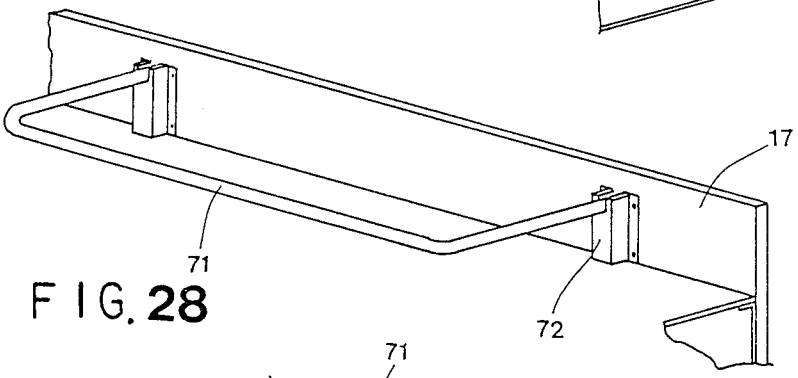

The second safety device 70 is a management mechanism for managing the basic elevation operation of the elevation bed 1. As shown in FIGS. 26 to 35, the elevation management mechanism 70 is divided into two systems, i.e., a guard handrail 71 which is disposed on at least one of the sides along the sides of the upper surface of the bed main body 10 and the upper surface of a decorative frame 17 which is formed around the periphery, and these two systems are assembled as the elevation management mechanism 70. First of all, when the bed main body 10 is used, the guard handrail 71 is erected while it is turned down when the bed main body 10 ascends and when it is stored into the upper portion. Accordingly, the power source of the elevation device 30 as a whole is managed in accordance with the posture of the bed main body 10. In other words, the guard handrail is disposed under the erected state as shown in FIG. 26 on a support portion 72 disposed on the frame beam 11 of the bed main body 10 and under the turndown state such as shown in FIG. 27.

Figure 28:
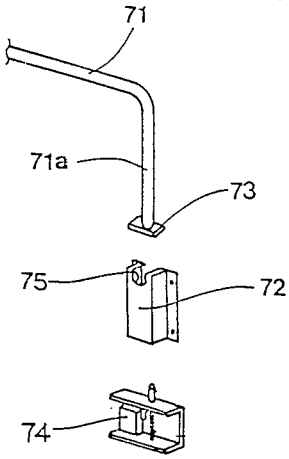
Figure 29:
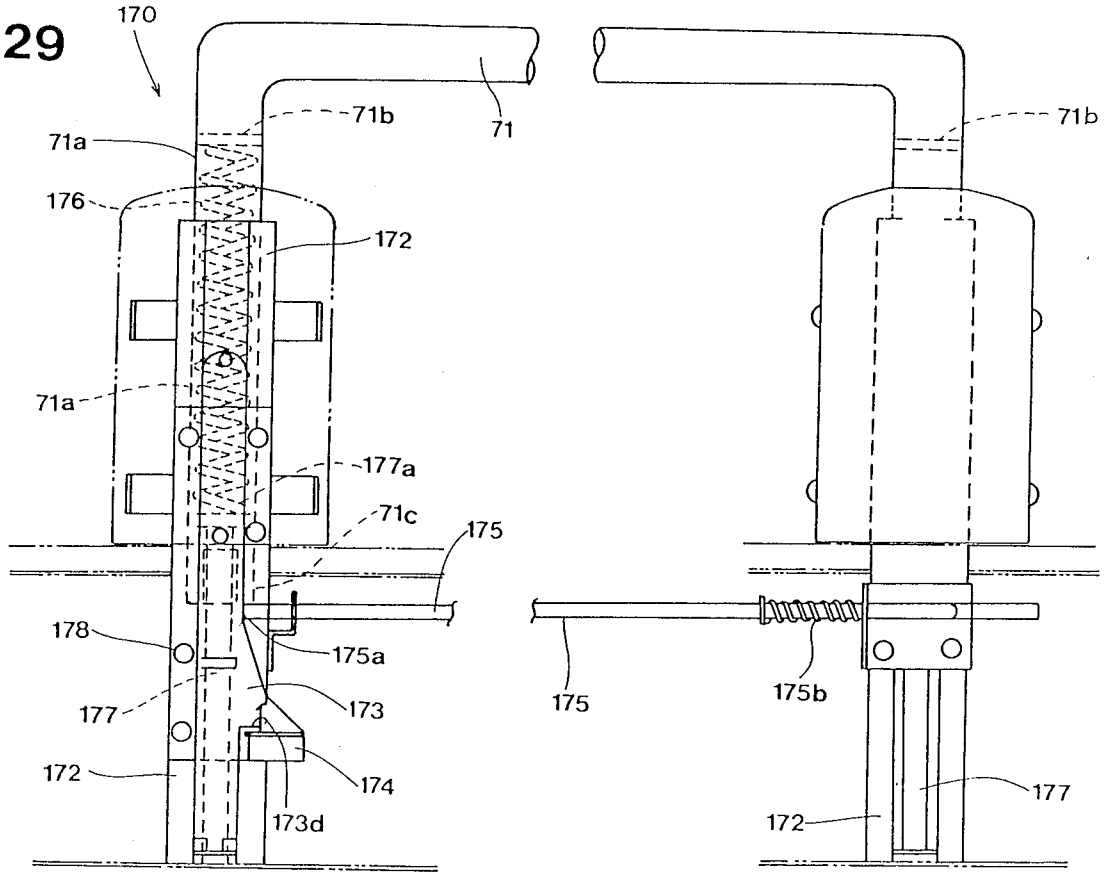
Figure 30:
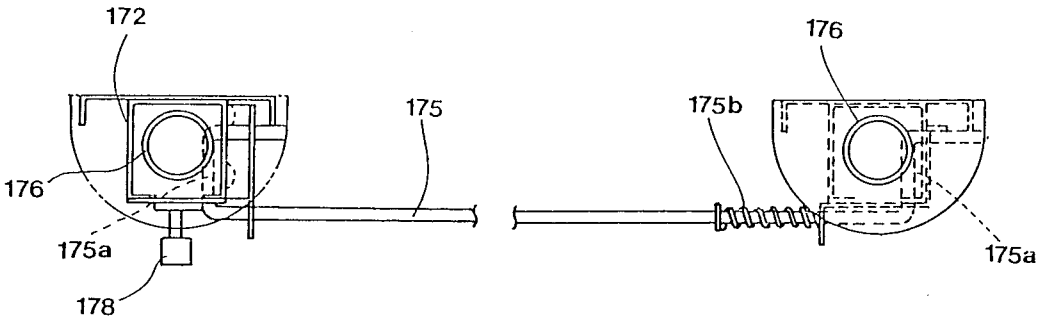
Figure 31:
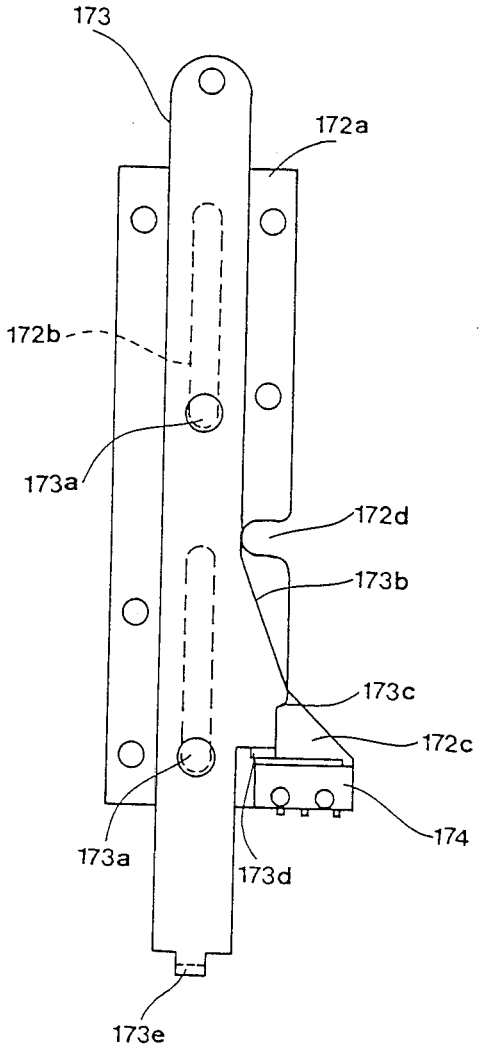
Figure 32:
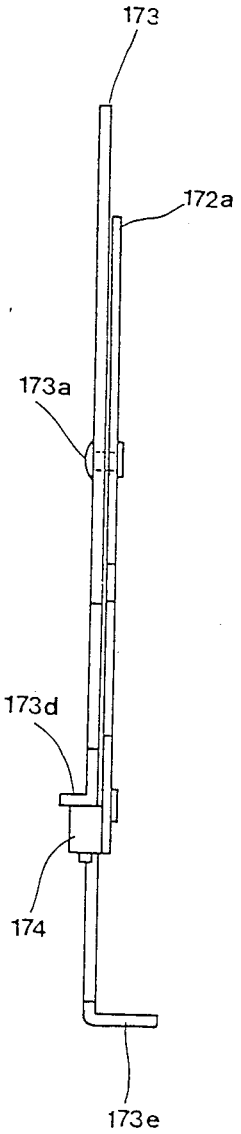

FIG. 28 shows in detail each part by an exploded view. The leg **71*a* of the guard handrail 71 is fitted into the support portion 72 slidably up and down and a horizontal operation plate 73 is fixed to the lower end of the leg 71*a* and pushes a management switch 74 which projects to the bottom of the support portion 72 under the erected state. When the operation plate 73 is turned down inward at a notch 75 formed at the top of the support portion while penetrating upward through the guard handrail 71, it opens the management switch 74. This management switch 74 cuts off the supply of the power source to the elevation device 30 when the elevation bed 1 is lowered and the guard handrail is erected in order to use the bed. When the bed is raisd when it is not used, the guard handrail 71 is turned down so that the management switch 74** connects the power source only this time.

Next, FIGS. 29 to 32 show another embodiment of the elevation management mechanism 70 to be disposed for the guard handrail 71. This elevation management mechanism 170 consists of the support portion 172, the operation plate 173, the management switch 174, the lock rod 175, the biasing spring 176 and the operation rod 177. The leg **71*a* of the guard handrail 71 is inserted into the support portion 172 and the upper part of the operation rod 177 is inserted into the lower end of the support portion 172. The biasing spring 176 is interposed between a receiving seat 71*b* fixed inside the leg 71*a* and the head 177*a* of the operations rod 177 and biases upward the guard handrail 71. The support portion has a rectangular groove horizontal cross-section and a guide plate 172*a* is fixed on its front surface. The operation plate 173 is meshed slidably in a vertical direction with a groove hole 172*b* of this guide plate through a pin 173*a*. A cam consisting of a slope 173*b* and a projection 173*c* continuing the lower end of the slope 173*b* is formed on one of the side edges of the operation plate 173, and a push plate 173*d* is formed by cutting up the end portion of the cam 173*c* below the cam while a pawl-like anchor plate 173*e* is formed inside the lowermost part of the cam. A knob 178 for operation is disposed on the lower front surface of the operation plate 173**.

Next, a lock rod 175 is bridged over and supported horizontally between both legs **71*a* of the handrail 71 and its both end portions 175*a* face the side edge portion of the operation plate 173, are meshed with the notch 172*d* of the guide plate 172*a* by the biasing spring 175*b* and support the lower end 71*c* of the leg 71*a*. The management switch 174 is supported by the bracket 172*c* which is part of one of the guide plates 172*a*, and under the state shown in FIG. 29, the push plate 173*d* is in contact with the switch 174**, which is therefore turned OFF.

The operation of the elevation management mechanism 170 will be explained with reference to the state of use of the elevation bed 1. The guard handrail 71 rises with respect to the support portion 172 due to the biasing spring 176 thereinside and the elevation bed 1 is in the state of use. However, since the management switch 174 is turned OFF, the elevation bed main body 10 does not start accidentally even if the elevation push button 31 is operated. Next, under the storage state, the operation plate 173 rises when the knob 178 is operated upward so that the push plate 173*d* comes off from the management switch 174 to turn it ON, and the elevation bed 1 can now be moved upward. On the other hand, hte lock rod 175 moves horizontally against the force of the biasing spring 175*b* and its end portion 175*a* moves outward along the slope 173*b*, and when the end portion 175*a* gets over the projection 173*c*, the operation plate 173 is locked temporarily thereby to release the support state of the lower end of the handrail 71 and to permit descension of the guard handrail 71. At the same time, the leg 71*a* can now enter the support portion 172. In other words, when the elevation bed 1 rises and the guard handrail 71 comes into contact with the ceiling 3, the biasing spring 176 is compressed and relative descension is effected with respect to the bed main body 10. The lower end of the leg 71*a* anchors to, and pushes down, the anchor plate 173*e* at the lower end of the operation plate 173 and at the same time, the push piece 173*d* turns OFF the management switch 174 to cut off the power source. Accordingly, the bed main body 10 stops within the protection range of the guard handrail 71.

Figure 33:
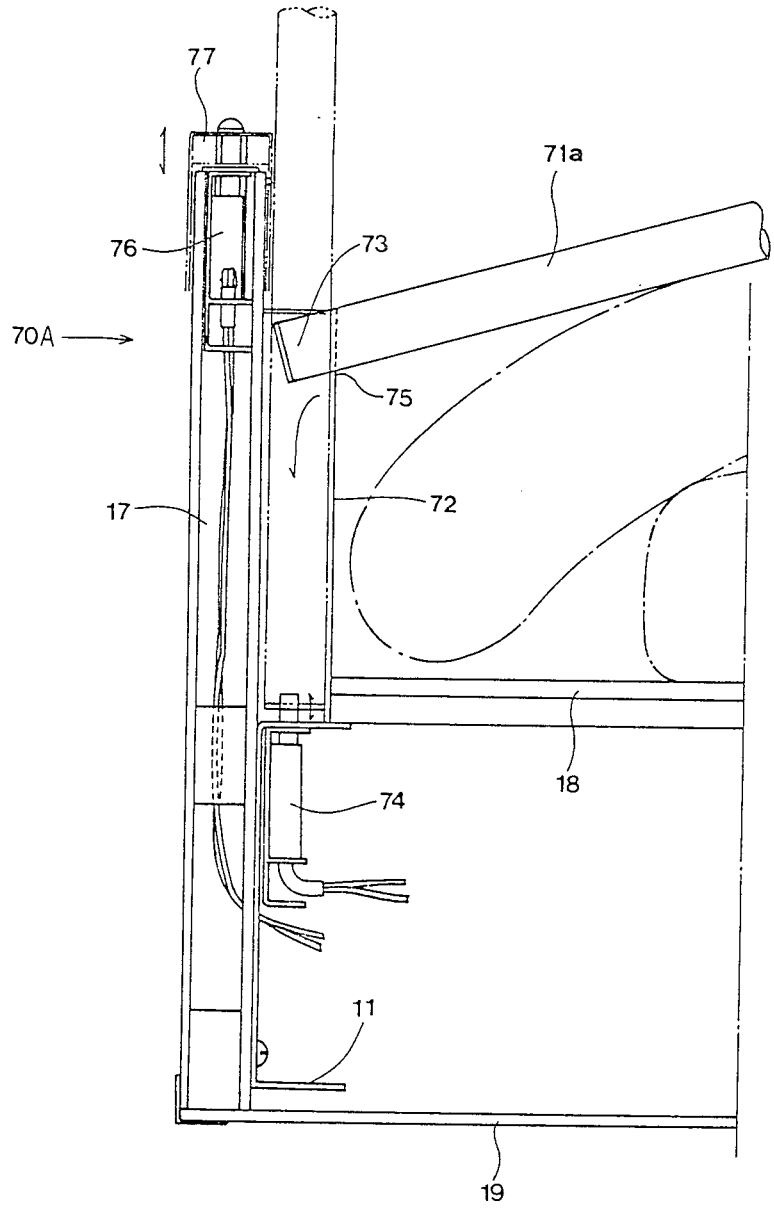
Figure 34:
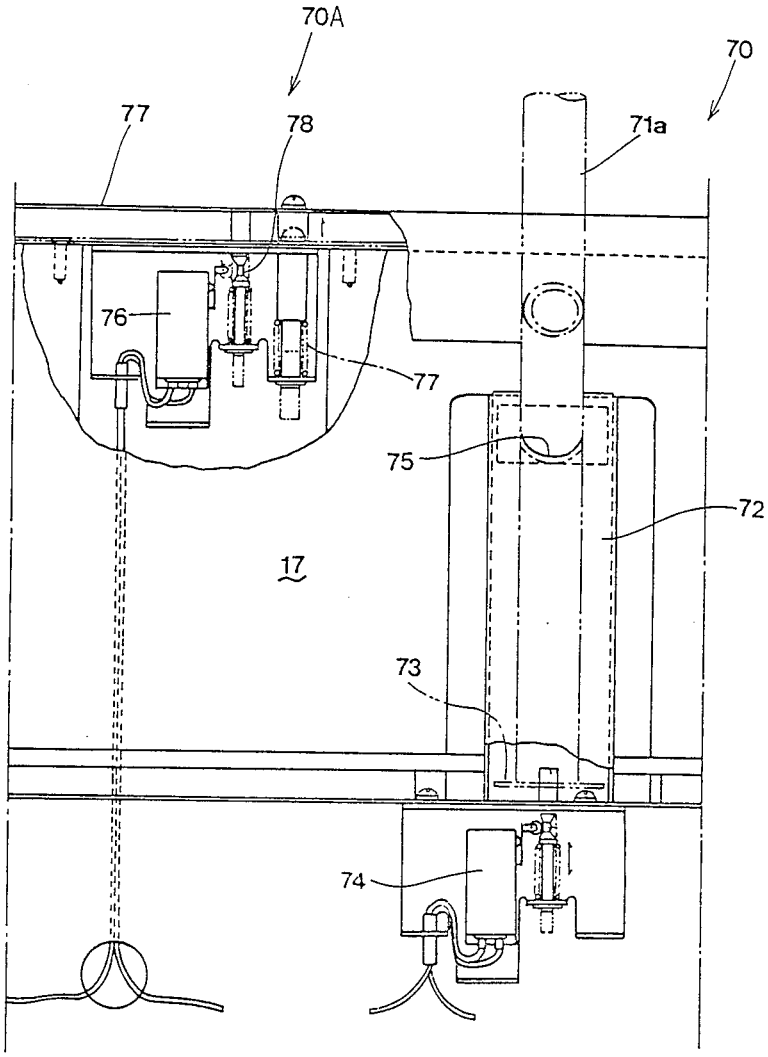

Next, FIGS. 33 and 34 show another embodiment of the elevation management mechanism. The elevation management mechanism 70A is fitted to the upper edge of the decorative frame 17 around the bed main body 10 and instructs the stop of operation of the bed main body 10 at an arbitrary time. The elevation management mechanism 70A includes a management switch 76, a biasing spring 78 for supporting upward a decorative edge 77 and an operation rod 79 and constitutes a touch sensor which cuts off manually the power source when a unexpected obstacle strikes the decorative edge 77 during ascension of the bed main body 10 and when the user judges the movement of the bed as being dangerous. Incidentally, there are shown in the drawings a floor surface 18 of the bed main body 10 and a partition plate 19 below the former, and the partition plate 19 constitutes a ceiling for the portions therebelow and has illumination equipment 6A. This illumination equipment can be selectively turned ON and OFF with the illumination equipment 6 of the ceiling 3 described already.

Figure 35:
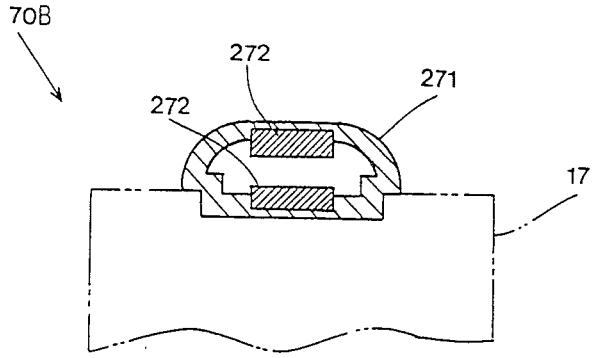

FIG. 35 shows still another embodiment of the elevation management mechanism. This elevation management mechanism 70B is of a simple type and is a beltlike touch sensor which replaces the decorative edge 77 to be fitted to the upper surface of the decorative frame 17. The sensor 70B is produced by integrally molding electrically conductive rubber belts in such a manner as to face each other in a vertical direction inside a flat, hollow and insulating rubber tube 271. When pushed from the upper surface fo the tube 271, the rubber belts 272 come into mutual contact to supply the power and to cut off the power source of the driving motor 41.

Figure 36:
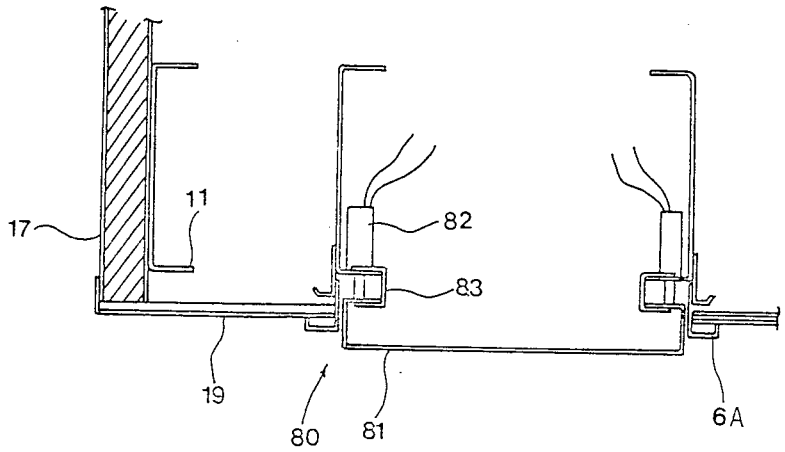
Figure 37:
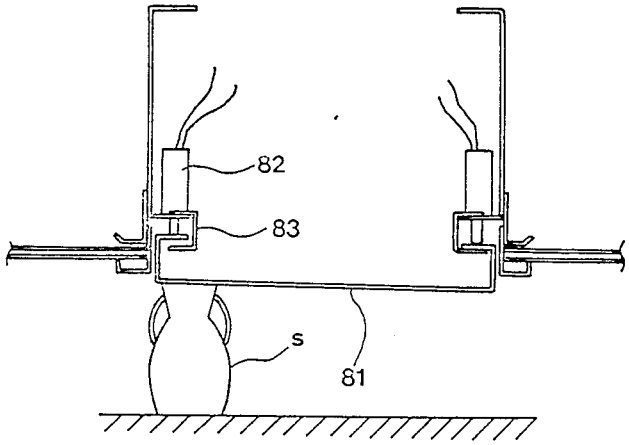

The third safety device 80 is means for limiting the lower end of descension of the bed main body 10. As shown in FIGS. 36 and 37, the third safety device 80 is assembled in the frame edge of the illumination equipment 6A to be disposed on the ceiling 19 of the lower surface of the bed main body 10 as a limit sensor 80 for limiting descension. This descension limit sensor 80 consists of an operation plate 81, a sensing switch 82 and a support frame 83 for supporting the operation plate 81, and the operation plate 81 is supporting in such a manner as to be capable of moving upward with respect to the support frame 83. As shown in FIG. 37, if any obstacle S or furniture 5 impedes descension of the bed main body 10, it operates the sensing switch 82 to cut off the power source.

Figure 38:
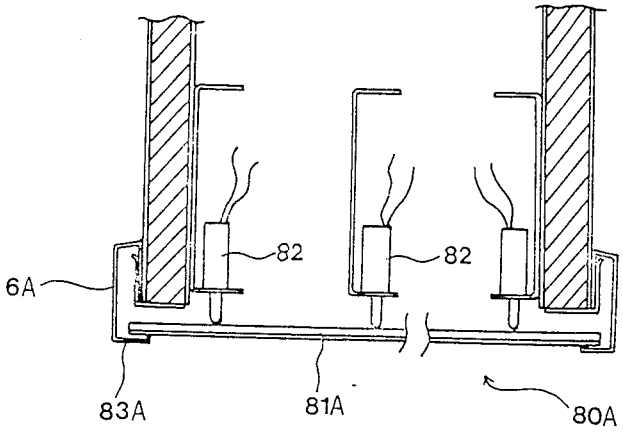

FIG. 38 shows another embodiment of the descension limit sensor as a descension limit sensor 80A. This descension limit sensor 80A has the same construction as the sensor described above, but the support frame 83A serves also as the support frame of the illumination equipment 6A. Preferably, the operation plate 81A is transparent or translucent and serves also as shade.

Figure 39:
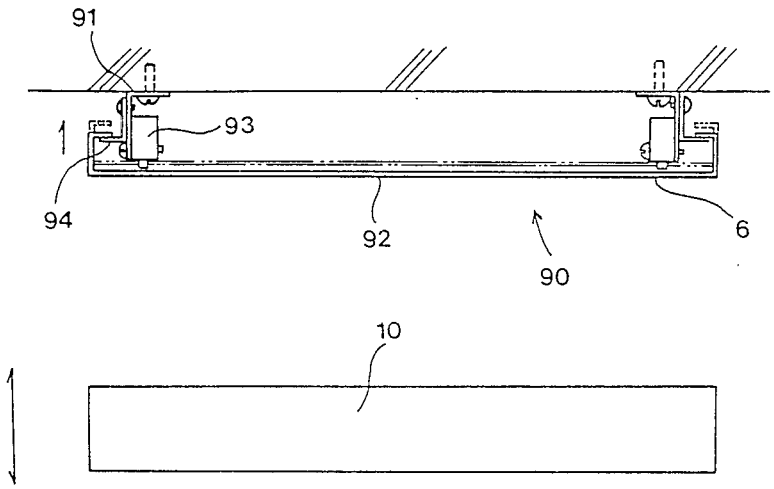
Figure 40:
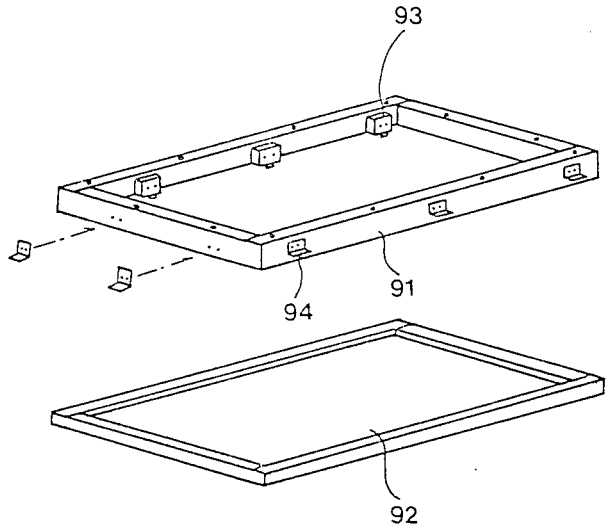

The fourth safety device 90 is means for limiting ascension of the bed main body 10. As shown in FIGS. 39 and 40, this means is disposed as an ascension limit sensor 90 which is assembled in a frame edge 91 and serves also as the illumination equipment 6 to be disposed in the ceiling 3 above the bed main body 10. This ascension limit sensor 90 consists of an operation plate 92, a sensing switch 93 and a support member 94 for supporting the operation plate 92 and cuts off the power source when the bed main body moves upward and its arbitrary portion inclusive of bedclothes comes into contact with the operation plate 92.

Figure 41:
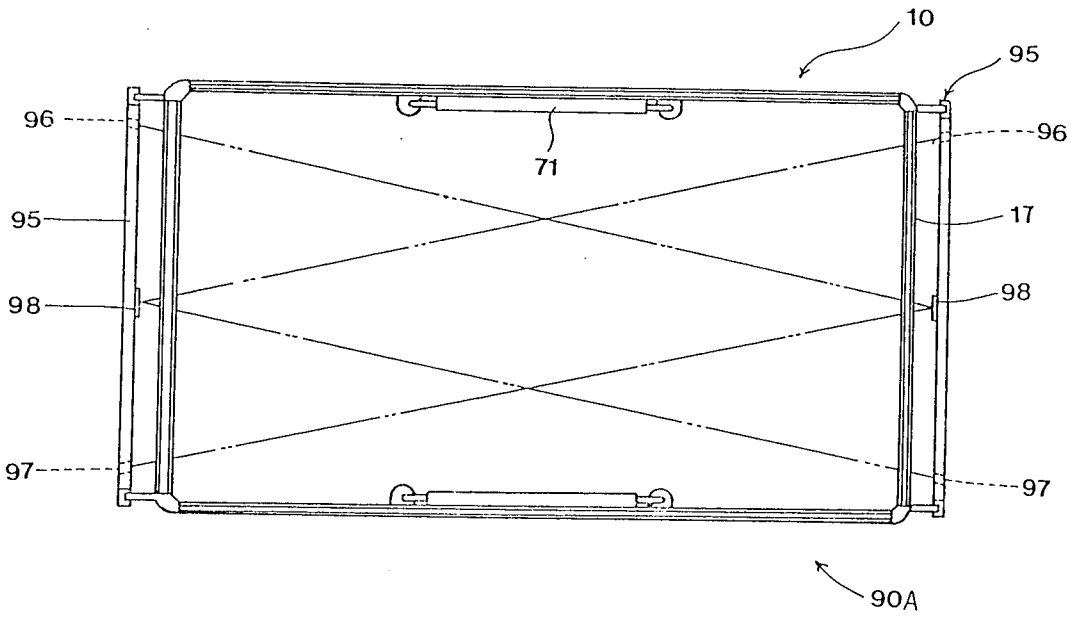
Figure 42:
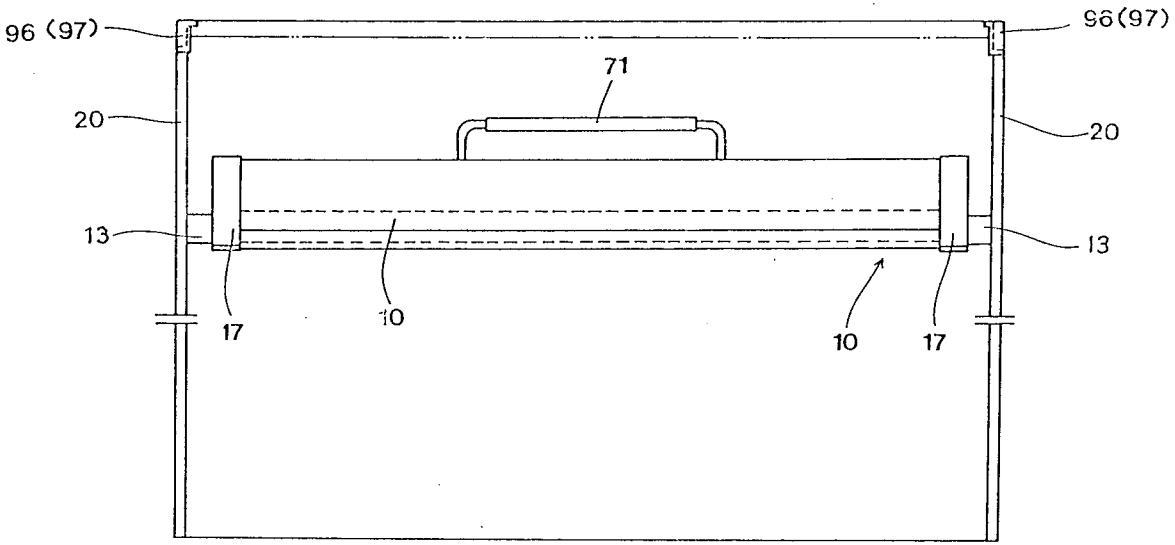

With the same object as described above, another ascension limit sensor 90A can be constituted as the fourth safety device 90. In other words, the safety device shown in FIGS. 41 and 42 is one that utilizes a photosensitive sensor as the safety device 90A. FIG. 41 is a plan view when viewed upward and FIG. 42 is its vertical sectional view. A pair of support members 95 to be extended between the support rods 20 are disposed at mutually opposing positions at the upper part of the wall 4 and light emitters 96, light receivers 97 and reflection mirrors are disposed on the support members 95, respectively. When the rising bed main body 10 or any other arbitrary article on the bed main body 10 cuts off the rays of light, the light receivers 97 are actuated and a photp-electric switch 90A cuts off the power source.

The touch sensor shown in the elevation management mechanism 70B described above can be used as a simple type sensor for the descension limit sensors 80, 80A and the ascension limit sensor 90 described already.

Figure 43:
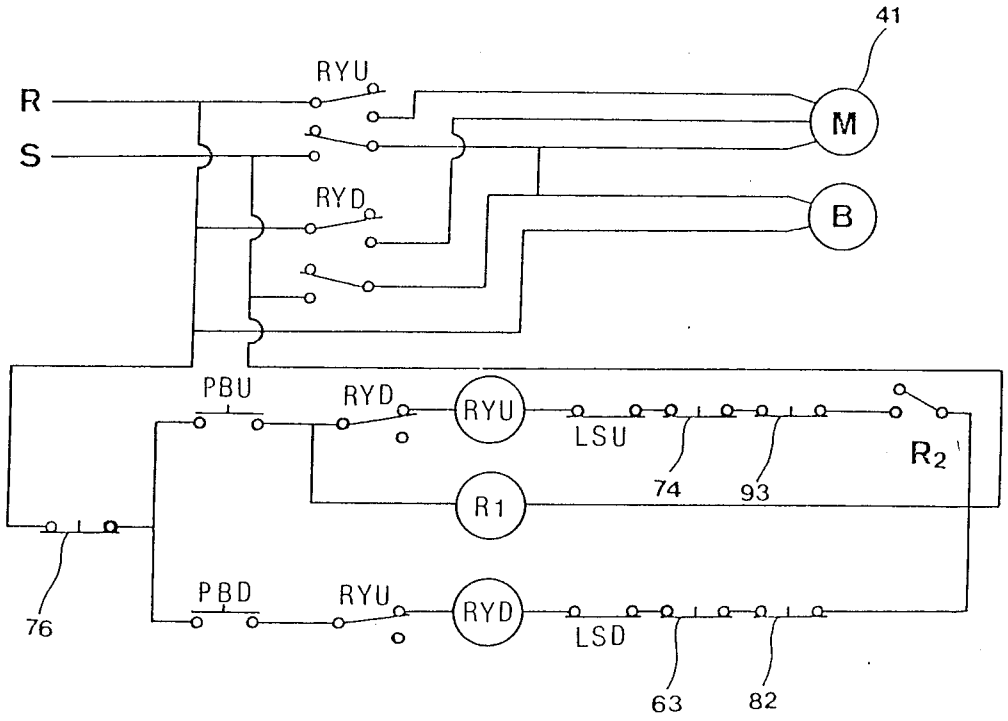
FIGS. 43 and 44 are electric circuit diagrams of a motor.
Figure 44:
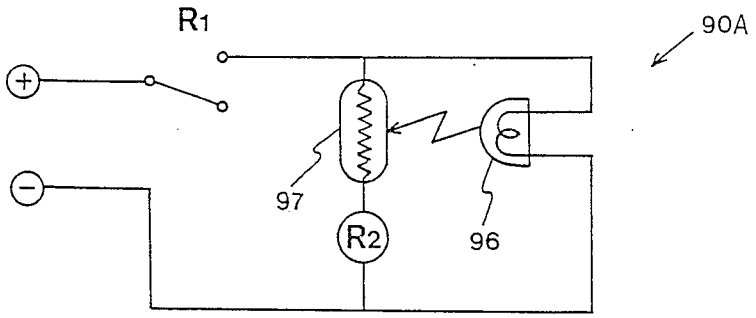

FIGS. 43 and 44 are electric wiring diagrams useful for explaining the slack sensor 60 as the first safety device the elevation management mechanism 70 as the second safety device, the descension limit sensor 80 as the third safety device and the ascension limit sensor 90 as the fourth safety device. The drawings show the power source circuit for the sensing switch 63, the management switches 74, 76, the sensing switch 82, the sensing switch 93 and the photoelectric switch 90A in the respective safety device. Among them, specific attention should be paid to the arrangement wherein the management switch 76 and the like of the elevation management mechanism 70A, 70B is disposed preferentially to other switches. In the drawings, symbol R represents a relay and the operation of each portion could be easily understood as cut-off means of each switch. Though the circuit diagrams show the case where all the various safety devices are installed, part of them can of course be omitted.

Figure 45:
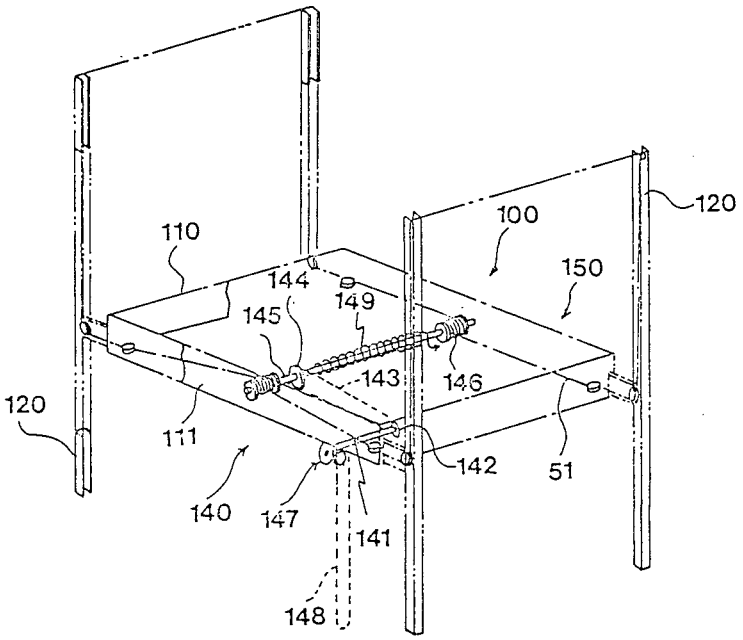
FIG. 45 is an overall perspective view when the elevation bed is of a manual type.

Next, the elevation bed of the present invention, when it is of a simple manual operation type, will be described with reference to FIG. 45. The elevation bed 1 is represented by reference numeral 100 in this drawing, and reference numerals of the other constituent elements can be understood in a corresponding manner. The elevation bed 100 inlcudes the bed main body 110 and the support rods 120, and the elevation device 130 consists of the manual winding mechanism 140 and the manual driving system 150. The manual elevation bed 100 is produced by replacing the winding mechanism 40 in the elevation device 130 used for the elevation bed 1 by the manual winding mechanism 140 and using the driving system 150 which is the same as the driving system 50 described already. In this manner, the electric elevation bed 1 can be easily changed to the manual elevation bed 100.

The winding mechanism 140 consists of the operation shaft 141 supported by the bed main body 110, the driving sprocket 142 fixed to this shaft, the chain 143, the follower sprocket 144, the rotary shaft 145 which support the follower sprocket 144 and whose both ends are pivotally supported by the frame beams 111 of the bed main body 110, the two wire drums 146 fixed to this rotary shaft 145, the gear box 147 disposed at the outer end of the operation shaft 141 and an operation string or chain 148 providing revolution to the gear box. Any particular description will not be necessary for the elevation of the bed main body 110 by the operation of the operation string or the like. Unlike the embodiment described above, however, two each wires 51 disposed at the four corners are wound on the wire drums 146 in the same direction for simplification. A coil spring 149 is wound on the rotary shaft 145 to urge the rotary shaft in the reverse direction when the bed main body 110 moves up, in order to reduce the manual operation.

Figure 46:
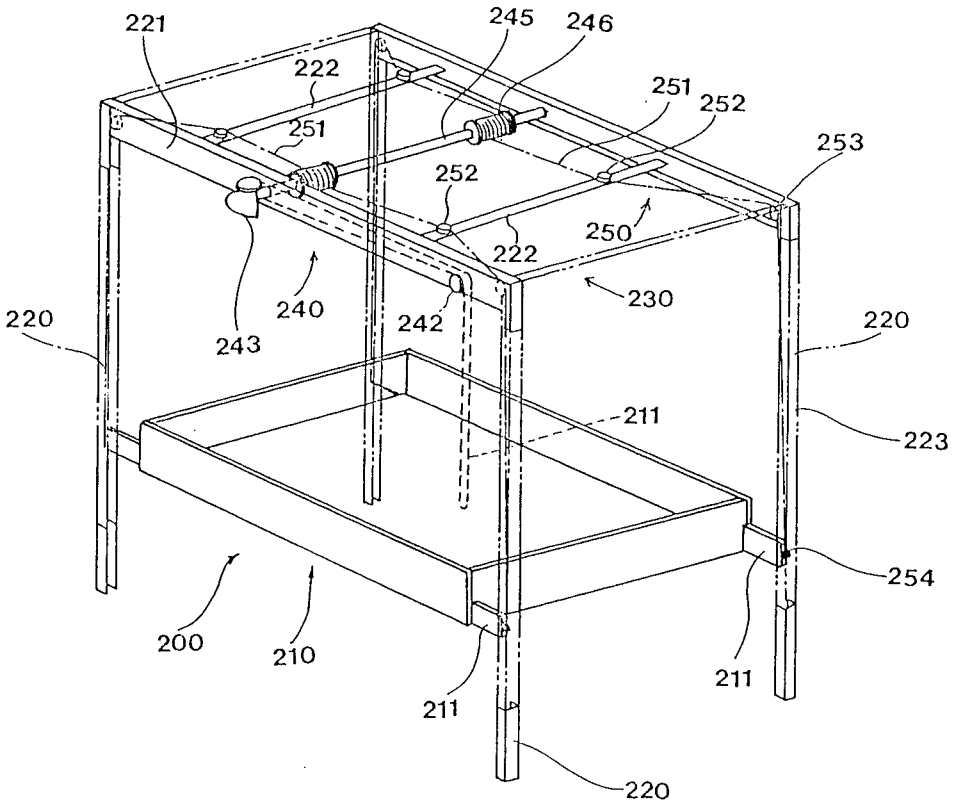
FIG. 46 is a perspective view of another embodiment of the manual elevation bed.

FIG. 46 shows another embodiment of the manual elevation bed. The elevation bed 200 is changed stably to the operation of the elevation bed 100 described above in that the operation is effected sideways of the bed main body 110 that moves up and down. In the manual elevation operation, the gravitational force is utilized for descension. Therefore, the support rods 220 are connected at their upper end portions by beams 221 and small beams 222 are added to form a frame assembly. The bed main body 220 is suspended and moved up and down by the elevation device 230 disposed on the frame assembly of the support rods 220. This elevation device 230 consists of the winding mechanism 240 and the driving system 250. The winding mechanism 240 consists of an endless operation string 241 for the manual operation, an intermediate pulley 242 and a gear box 243 of a worm mechanism that are supported by the beams 221, a rotary shaft 245 extended pivotally between the opposed beams 221 and two wire drums 246 fixed to this rotary shaft 245.

On the other hand, one of the ends of the wire 251 of the driving system is fixed to the wire drum 246 and wound through an intermediate sheave 252 pivotally supported by the small beam 222 and an intermediate sheave 253 supported pivotally by the frame beam 221, inserted through the guide rail 223, and then extends downward with the other end 254 being fixed to the outer end of the anchor assembly 211 at the corner of the bed main body 210. The winding mechanism 240 is driven by the operation string 241 to elevate the bed main body 210 and this operation will not need any specific description as the action of the invention.

Figure 47:
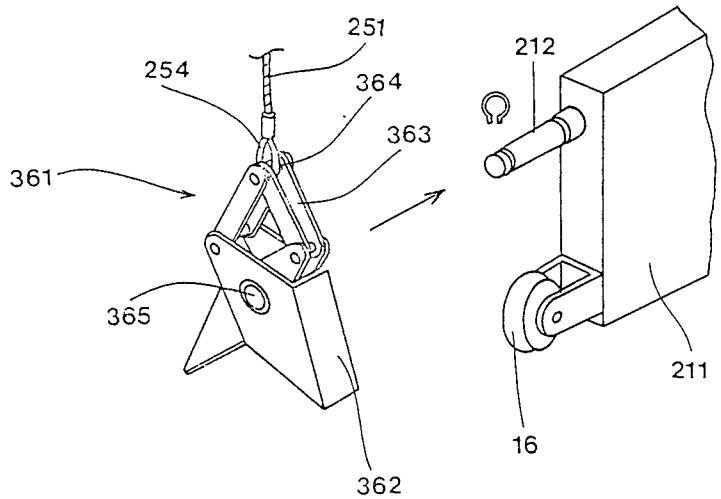
FIG. 47 is an exploded perspective view of an emergency stop device.
Figure 48:
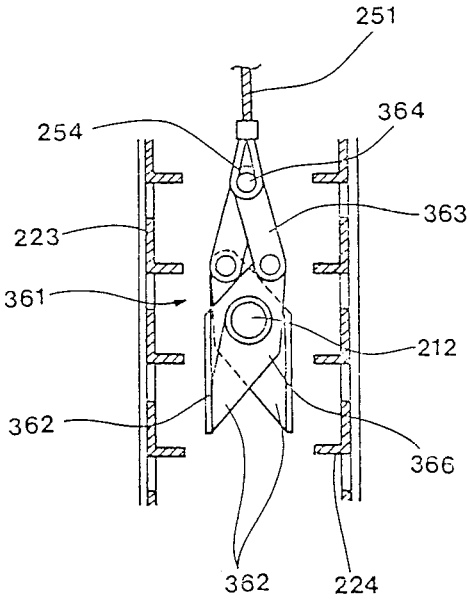
FIGS. 48 and 49 are front views under normal state and emergency state of each part of the emergency stop device.
Figure 49:
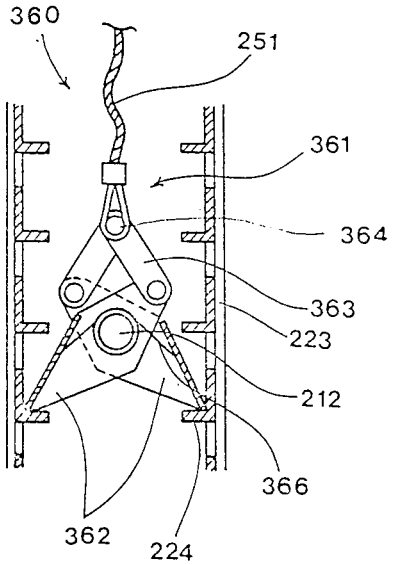

The elevation operation of this manual elevation bed 200 is based on the premise that safety management is carried out by user of the bed. Therefore, the safety means for cutting off the power source is not disposed, but safety means against breakage of the wire 251 is installed as an emergency stop device 360 having a mechanical construction. The emergency stop device 360 is disposed between the outer end of the anchor assembly 211 and the guide rail 223 and consists of a stopper assembly 361 and a horizontal anchor portion 224 formed by cutting up the guide rail 223 throughout its full length as shown in FIGS. 47 and 49. The stopper assembly 361 consists of a pair of stoppers 362 that cross slantingly each other, links 363 connected to the upper ends of the stoppers 362 and an anchor pin 364 for anchoring rotatably the upper ends of both links 363. A support shaft 212 projects from the end surface of the anchor assembly 211 above the slide roller 16 and a shaft hole 365 bored at the point of intersection of the stoppers 362 is fitted to this shaft 212 to fix the stopper assembly 361. A spring 366 is disposed with the support shaft 212 being the center and urges the lower end of each stopper 362 to open.

On the other hand, the tip 254 of the wire 251 is fixed to the anchor pin 364 and the tip of the stopper 362 is closed against the force of the spring 366 when tension is applied to the wire 251. Therefore, the bed main body 210 can move up and down freely inside the guide rail 223. When the wire 251 is cut off for some reason or other during elevation of the elevation bed 200, the stoppers 362 are opened by the force of the biasing spring 366 and strike the upper surface of the anchor portion 224 so that the descending operation of the bed main body 210 stops.

Figure 50:
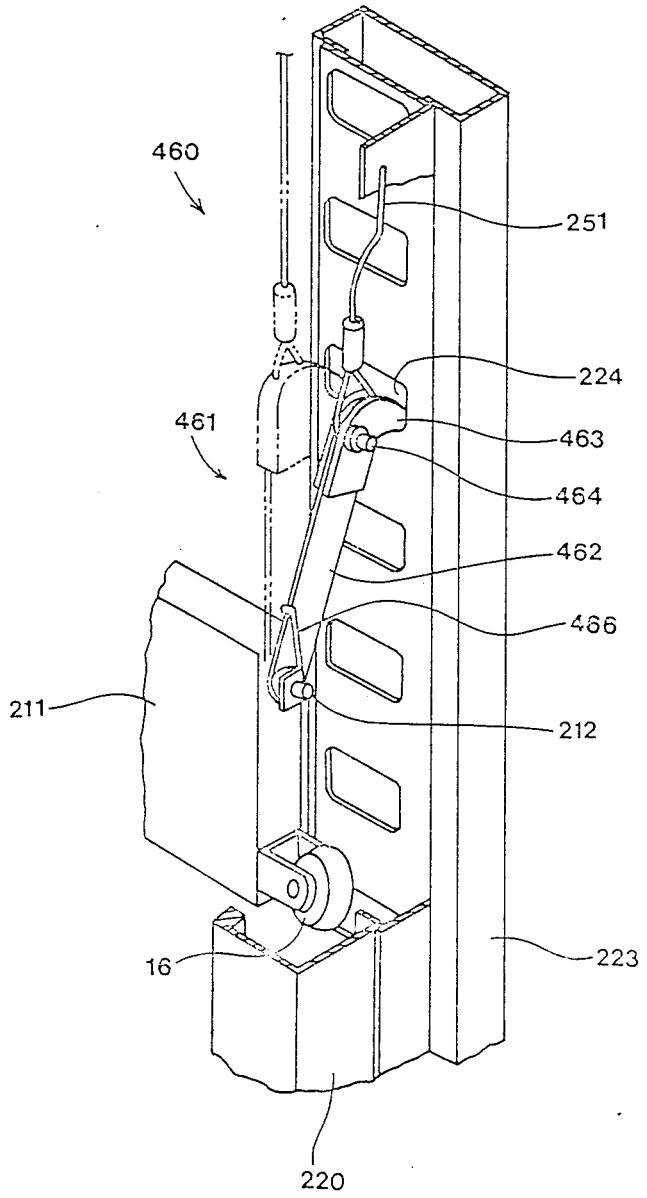
FIG. 50 is a perspective view of another embodiment of the emergency stop device.

FIG. 50 shows another embodiment of the emergency stop device. This emergency stop device 460 consists of the stopper assembly 461 and the anchor portion 224 disposed on the side of the guide rail 223 and the anchor portion 224 in this case is openings bored and aligned on the flange of the guide rail 223. The stopper assembly 461 consists of a rod-like stopper 462 which supports pivotally the lower end of the support shaft 212, a hook member 463 disposed at the tip of the stopper 462 and meshing with the anchor portion 224, an anchor pin 464 and a biasing spring 466. The operation when the elevation wire 251 fixed to the anchor pin 464 is broken is the same as described above.

A main wire sheave is disposed at a part of the anchor assembly of the bed main body in the same way as in the elevation bed 1 or 100, and when the emergency stop device is necessary while the end of the wire is not fixed to the main sheave, the posture of retreat is assumed normally by use of the tension of the wire and when tension is lost in the case of emergency, the operation member is anchored to the guide rail, with another emergency stop device. One example of such an emergency stop device is assembled in the anchor assembly 13 or the like and the stopper and the anchor roller disposed at the outer end of the device project into the guide rail. On the other hand, the inner end of the support assembled at the end portion is connected to the fixed portion such as the frame beam 11 or the cylinder member 14 through the biasing spring so that the biasing roller is extended by the wire 51, which receives tension under the normal state, through the anchor roller. When the wire is broken, the stopper is anchored to the guide rail by the biasing spring and the bed main body 10 is stopped at the elevating position. Such a construction can be obtained within the range of application of the present invention.

INDUSTRIAL APPLICABILITY:

In consideration of the large occupying area of the bed as one of the large items of furniture, the elevation bed of the present invention is lowered near the floor when in use but can be stored in the ceiling when out of use by elevating it while keeping the horizontal posture so that the space below the bed can be utilized in combination with the other indoor space. The elevation device for moving the bed up and down may be of an electric type or a manual type and includes the safety devices necessary for the elevation of the large furniture. Therefore, the elevation bed of the invention contributes greatly to the diversified ways of living in a limited indoor space and to all the industries associated with furniture and eventually, to the construction industry.

What is claimed is:

1. An elevation bed comprising:

a main body having a frame assembly;

support rods disposed vertically between the floor and the ceiling, supporting elevatably said bed main body, and having a grooved cross-section, wherein the bed main body has anchor mean for corresponding support rods at both ends of frame beams on both sides thereof, and each of said anchor means is capable of retraction and rocking with respect to said frame beam and is equipped at the tip thereof with a main sheave for a driving system part of which is positioned inside a guide rail groove of said support rod and with a guide roller which comes into sliding contact with the inner edge of said guide rail, at the tip therof;

an elevation device for elevating said bed main body;

a safety device; and said elevation device including a winding mechanism assembled in said bed main body and a wire driving system having both ends thereof fixed to said winding mechanism and to said support rods.

2. The electric elevation bed as defined in claim 1, wherein said winding mechanism is of an electric type.

3. The electric elevation bed as defined in claim 2, wherein said winding mechanism includes a motor, a driving sprocket, a chain, a follower sprocket, a rotary shaft and a winding drum fixed to said rotary shaft, and one of the ends of a wire rope of said wiring driving system is fixed to each of said winding drums, and after being wound on a plurality of intermediate sheave supported pivotally on said bend main body, said wire rope is arranged inside said guide rail through each main sheave, and the other end of said wire rope is fixed to the upper part of said support rod.

4. The electric elevation bed as defined in claim 3, wherein said safety device includes electric means for checking the start of said motor or for stopping the operation of said motor at the time of use of said elevation bed and is equipped with all of a slack sensor of said wire, a management mechanism for the elevating operation of said bed main body, an ascension limit sensor for limiting the ascension of said bed main body and a descension limit sensor for limiting the descension of said bed main body, or includes them in combination.

5. The electric elevation bed as defined in claim 4, wherein said safety device for sensing the slack of said wire is disposed at said intermediate sheave of each of said driving system and includes a bed seat movably supporting said intermediate guide with respect to said bed main body, a biasing spring anchored to said bed seat and a sensing switch for sensing its movement.

6. The electric elevation bed as defined in claim 4, wherein said management mechanism for the elevating operation of said bed main body is assembled in a guard handrail disposed on the upper side surface of said bed main body, and said guard handrail can stand up and come down with respect to said bed main body, checks the start of elevation or stops the elevation of said bed main body when it stands up and permits the elevation of said bed main body when it comes down.

7. The electric elevation bed as defined in claim 4, wherein said management mechanism for the elevating operation of said bed main body includes a touch sensor disposed on the upper surface of a decorative frame of said bed main body.

8. The electric elevation bed as defined in claim 4, wherein said safety device for limiting the ascension of said bed main body includes a touch sensor disposed on the surface of the ceiling.

9. The electric elevation bed as defined in claim 4, wherein said safety device for limiting the ascension of said bed main body is a photo-sensitive sensor disposed in the horizontal plane close to the surface of the ceiling.

10. The electric elevation bed as defined in claim 4, wherein said safety device for limiting the descension of said bed main body inculdes a touch sensor disposed on the lower surface of said bed main body.

11. The manual elevation bed as defined in claim 1, wherein said winding mechanism is of a manual type.

12. The elevation bed as defined in claim 11, wherein said winding mechanism includes a rotary shaft, a winding drum fixed to said rotary shaft, and operation string and its transmission means.

13. The elevation bed as defined in claim 1, wherein said safety device is mechanical means for preventing drop at the time of breakage of said wire.

14. The elevation bed as defined in claim 13, wherein said drop prevention means at the time of breakage of said wire is an emergency stop device constructed in such a manner as to assume a posture under which said wire can pass through said guide rail due to the tension applied thereto and a posture under which said wire is anchored to said guide rail by release of a load.

15. The elevation bed as defined in claim 14, wherein each of said support rods has a guide rail having a grooved cross-section and bent members on both edges of said guide rail, and is equipped with stop members for said bed main body at a predetermined height from the lower end in such a manner as to be capable of moving and being fixed.

16. The elevation bed as defined in claim 15, wherein the surface of the ceiling is folded up above said bed main body and the lower surface of said bed main body to be stored is on the same plane as the ordinary ceiling.

17. The elevation bed as defined in claim 16, wherein a ladder for use between the floor surface and said bed main body at the time of use of said bed main body is provided foldably and detachably to said bed main body.

18. The electric elevation bed as defined in claim 2, wherein said safety device includes electric means for checking the start of said motor or for stopping the operation of said motor at the time of use of said elevation bed and is equipped with all of a slack sensor of said wire, a management mechanism for the elevating operation of said bed main body, an ascension limit sensor for limiting the ascension of said bed main body and a descension limit sensor for limiting the descension of said bed main body, or includes them in combination.

19. The elevation bed as defined in claim 1, wherein each of said support rods has a guide rail having a grooved cross-section and bent members on both edges of said guide rail, and is equipped with stop members for said bed main body at a predetermined height from the lower end in such a manner as to be capable of moving and being fixed.

20. The elevation bed as defined in claim 1, wherein the surface of the ceiling is folded up above said bed main body and the lower surface of said bed main body to be stored on the same plane as the ordinary ceiling.

21. The elevation bed as defined in claim 1, wherein a ladder for use between the floor surface and said bed main body at the time of use of said bed main body is provided foldably and detachably to said bed main body.

22. In an elevation bed including:

a bed main body having a framed assembly;

support rods of a guard rail type disposed vertically between the floor and the ceiling and supporting elevatably said bed main body;

an elevation device for elevating said bed main body; and a safety device;

said elevation device including an electric winding mechanism to be incorporated in said bed main body and a wire driving system having both ends thereof wound and fixed to said winding mechanism and said support rods;

a slack sensor of a driving system of an electric elevation bed comprising:

a bracket fixed to said bed main body;

bed seat supported movably by said bracket;

an intermediate sheave of said wire supported pivotally by said bed seat;

a sensing switch; and a biasing spring;

said slack sensor cutting off the power source for elevation when said wire gets slack.

23. In an elevation bed including:

a bed body having a frame assembly; support rods of a guard rail type disposed vertically between the floor and the ceiling and supporting elevatably said bed main body;

an elevation device for elevating said bed main body; and a safety device;

said elevation device including an electric winding mechanism to be incorporated in said bed main body and a wire driving system having both ends thereof wound and fixed to said winding mechanism and said suppot rods;

a slack sensor of a driving system of an electric elevation bed comprising:

a bracket fixed to said bed main body;

a bed seat supported movably by said bracket;

an intermediate sheave of said wire supported pivotally by said bed seat;

another intermediate sheave coaxial with said bead seat;

a sensing switch; and a biasing spring;

said slack sensor cutting off the power source for elevation when said wire gets slack.

24. In an elevation bed including:

a bed main body having a frame assembly; support rods of a guard rail type disposed vertially between the floor and the ceiling and supporting elevatably said bed main body;

an elevation device for elevating said bed main body; and a safety device;

said elevation device including an electric winding mechanism to be incorporated in said bed main body and a wire driving system having both ends thereof wound and fixed to said winding mechanism and said support rods;

an elevation management mechanism of an electric elevation bed comprising:

a guard handrail having the legs thereof inserted into support portions disposed on said bed main body and equipped at its lower end with an operation plate;

a management switch disposed at the bottom of said support portion; and turn-over means disposed at the upper end of said support portion to face inward, capable of letting said guard handrail assume and erected posture and a turnover posture;

said operation plate actuating said management switch under the erected posture to cut off the power source for elevation.

25. In an elevation bed including:

a bed main body having a frame assembly;

support rods of a guard rail type disposed vertically between the floor and the ceiling and supporting elevatably said bed main body;

an elevation device for elevating said bed main body; and a safety device;

said elevation device including an electric winding mechanism to be incorporated in said bed main body and a wire driving system having both ends thereof wound and fixed to said winding mechanism and said support rods; an elevation management mechanism of an electric elevation bed comprising:

a decorative adge disposed around the upper surface of said bed main body and supported upward and resiliently by a biasing spring;

a management switch; and an operation rod;

said members forming a touch sensor which cuts off the power source for elevation when said decorative edge moves downward.

26. In an elevation bed including:

a bed main body having a frame assembly;

support rods of a guard rail type disposed vertically between the floor and the ceiling and supporting elevatably said bed main body;

an elevation device for elevating said bed main body; and a safety device;

said elevation device including an electric winding mechanism to be incorporated in said bed main body and a wire driving system having both ends thereof wound and fixed to said winding mechanism and said support rods;

an elevation management mechanism of an electric elevation bed comprising:

a decorative edge disposed around the upper surface of said bed main body and made of a flat flexible material; and a management switch consisting of electrodes disposed inside said decorative edge in such a manner as to face each other in a veritical direction;

said members forming a touch sensor which supplies the power due to deformation of said decorative edge when it is pushed, and cuts off the power source for elevation.

27. In an elevation bed including:
a bed main body having a frame assembly;
support rods of a guard rail type disposed vertically between the floor and the ceiling and supporting elevatably said bed main body;
an elevation device for elevating said bed main body; and
a safety device;
said elevation device including an electric winding mechanism to be incorporated in said bed main body and wire driving system having both ends thereof wound and fixed to said winding mechanism and said support rods;
an ascension limit sensor for an electric elevation bed comprising:
a frame edge of ceiling surface disposed on the lower surface of the ceiling above said bed main body;
support members supported veritcally movably by said frame edge;
an operation plate extended horizontally to said support members; and
a sensing switch;
said members forming a touch sensor which cuts off the power source for elevation due to ascension of said bed main body.

28. The ascension limit sensor for an electric elevation bed as defined in claim 27, wherein said frame edge serves also as a frame member of illumination equipment disposed on the ceiling.

29. In an elevation bed including:
a bed main body having a frame assembly;
support rods of a guard rail type disposed vertically between the floor and the ceiling and supporting elevatably said bed main body;
an elevation device for elevating said bed main body; and
a safety device;
said elevation device including an electric winding mechanism to be incorporated in said bed main body and a wire driving system having both ends thereof wound and fixed to said winding mechaniam and said support rods;
an ascension limit sensor of an electric elevation bed comprising:
light emitters, light receivers, reflection mirrors and photoelectric switches that are disposed on the wall below the ceiling and sideways of said bed main body in such a manner as to face one another, respectively, and to cut off the power source for elevation when the rays of light are cut off due to elevation of said bed main body.

30. In an elevation bed including:
a bed main body having a frame assembly;
support rods of a guard rail type disposed vertically between the floor and the ceiling and supporting elevatably said bed main body;
an elevation device for elevating said bed main body; and
a safety device;
said elevation device including an electric winding mechanism to be incorporated in said bed main body and a wire driving system having both ends thereof wound and fixed to said winding mechanism and said support rods;
a descension limit sensor of an electric elevation bed comprising:
a frame edge disposed on the lower surface of said bed main body;
support members supported vertically movably by said frame edge;
an operation plate extended vertically to said support members; and
a sensing switch;
said members forming a touch sensor which cuts off the power source for elevation when said bed main body impinges against any obstacle when it descends.

31. The descension limit sensor of an electric elevation bed as defined in claim 30, wherein said frame edge serves also as a frame member of illumination equipment disposed on the ceiling.

32. In an elevation bed including:
a bed main body having a frame assembly;
support rods of a guard rail type disposed vertically between the floor and the ceiling and supporting elevatably said bed main body;
an elevation device for elevating said main body; and
a safety device;
said elevation device including an electric winding mechanism to be incorporated in said bed and a wire driving system having both ends thereof wound and fixed to said winding mechanism and said support rods;
stoppers characterized in that each of said stoppers is disposed at a lower part of said support rod, meshes selectively with engagement groove holes bored and aligned on the side surface of said guide rail and limits the lower limit of descension of said bed main body.

33. In an elevation bed including:
a bed main body having a frame assembly;
support rods of a guard rail type disposed vertically between the foor and the ceiling and supporting elevatably said bed main body;
an elevation device for elevating said bed main body; and
a safety device;
said elevation device including an electric winding mechanism to be incorporated in said bed main body and wire driving system having both ends thereof wound and fixed to said winding mechanism and said support rods;
a stopper assembly characterized in that said stopper assembly is disposed at the lower part of said support rods, consists of an outer anchor plate, an inner anchor plate and a fastening screw for fastening both of said anchor plates, is fixed to said support rods when said anchor plates are fastened, and sets the lower limit of descension of said bed main body.

34. In an elevation bed including:
a bed main body having a frame assembly;
support rods of a guard rail type disposed vertically between the floor and the ceiling and supporting elevatably said bed main body;
an elevation device for elevating said bed main body; and
a safety device;
said elevation device including an electric winding mechanism to be incorporated in said bed main body and a wire driving system having both ends thereof wound and fixed to said winding mechanism and said support rods;
a stopper assembly characterized in that said stopper assembly is disposed at the lower part of said support rods, consists of an outer anchor plate, an inner anchor plate, a fastening screw for fastening both of said anchor plates and an operation member having an inverted V-shape, said operation member has a knob and capable of opening and closing the legs thereof, meshes selectively with anchor portions formed and aligned on the side of said guard rail, is fixed to said support rods when both of said anchor plates are fixed, and sets the lower limit of descension of said bed main body.

35. The stopper assembly as defined in claim 34, wherein said outer anchor plate has a horizontal portion at the upper part thereof and regulates and sets the lower limit of descension of said bed main body by an adjustment screw meshing with said horizontal portion.

36. In an elevation bed including:

a bed main body having a frame assembly;

support rods disposed vertically between the floor and the ceiling, supporting elevatably said bed main body and having a grooved cross-section; and a safety device;

said elevation device including a winding mechanism mounted to a support structure formed at the upper part of said support rods and a wire driving system wound and fixed at both ends thereof to said winding mechanism and said bed main body;

emergency stop device characterized in that said emergency stop device consists of a stopper pivotally supported at a fixed portion of a wire to said bed main body, can pass through said guide rail by suspension tension of said wire, opens the legs thereof by a biasing spring at the time of breakage of said wire and anchors to an anchor portion formed on said guide rail, and a link interconnecting said stopper to the end portion of said wire, and said stopper and said link together form drop prevention means at the time of breakage of said wire.

37. An elevation bed comprising:

a bed main body having a frame assembly;

support rods disposed vertically between the floor and the ceiling, supporting elevatably said bed main body, and having a grooved cross-section;

an elevation device for elevating said bed main body;

a safety device;

said elevation device including an electric-type driving mechanism and a wiring system having both ends thereof fixed to said driving mechanism and to said support rods; and said safety device including electric means for checking the start of a driving motor of said elevation device of for stopping the operation of said motor at the time of use of said elevation bed.

38. An elevation bed as claimed in claim 37 wherein said safety device is equipped with at least one of devices such as a slack sensor of said wiring system, a management mechanism for the elevating operation of said bed main body, an ascension limit sensor for limiting the ascension of said bed main body, or a decension limit sensor for limiting the decension of said bed main body, or with their combination.

39. The elevation bed as claimed in claim 37 wherein said bed main body has anchor means for corresponding support rods at both ends of frame beams on both sides thereof, and each of said anchor means is capable of rectraction and rocking with respect to said frame beam and is equipped with the tip thereof with a main sheave for a driving system part of which is positioned inside said guide rail groove of said support rod and with a guide roller which comes into sliding contact with the inner edge of said guide rail, at the tip thereof.

40. An elevation bed comprising:

a bed main body having a frame assembly;

support rods disposed vertically between the floor and the ceiling, supporting elevatably said bed main body, and having a grooved cross-section;

an elevation device for elevating said bed main body, a safety device;

said elevation device including a manual-type driving mechanism and a wiring system having both ends thereof fixed to said driving mechanism and to said support rods; and said safety device including mechanical means for preventing drop of said bed main body at the time of breakage of wire in said wiring system.

41. The elevation bed as claimed in claim 40 wherein said bed main body has anchor means for corresponding support rods at both ends of frame beams on both sides thereof, and each of said anchor means is capable of retracting and rocking with respect to said frame beam and is equipped at the tip thereof with a main sheave for a driving system part of which is positioned inside said guide rail groove of said support rod and with a guide roller which comes into sliding contact with the inner edge of said guide rail, at the tip thereof.

42. The elevation bed as claimed in claim 40 wherein said drop prevention means at the time of breakage of said wire is an emergency stop device constructed in such a manner as to assume a posture under which said wire can pass through said guide rail due to the tension applied thereto and a posture under which said wire is achored to said guide rail by release of a load.

43. An elevation bed comprising:

a bed main body having a frame assembly;

support rods disposesd vertically between the floor and the ceiling, supporting elevatably said bed main body and having a grooved cross-section;

an elevation device for elevating said bed main body;

a safety device;

said elevation device including a driving mechanism disposed an a support structure formed at the upper part of said support rods and a wiring system having both ends thereof fixed to said driving mechanism and to said bed main body; and said safety device including mechanical means for preventing drop of said bed main body at the time of breakage of wire in said wiring system.

44. An elevation bed as claimed in claim 43 wherein said drop prevention means at the time of breakage of said wire is an emergency stop device constructed in such a manner as to assume a posture under which said wire can pass through said guide rail due to the tension applied thereto and a posture under which said wire is anchored to said guide rail by release of a load.

* * * * *